US006401428B1

(12) United States Patent
Glover et al.

(10) Patent No.: US 6,401,428 B1
(45) Date of Patent: Jun. 11, 2002

(54) FENESTRATION SEALED FRAME, INSULATING GLAZING PANELS

(75) Inventors: Michael Glover; Stephen Field, both of Ottawa (CA)

(73) Assignee: Bowmead Holding Inc., Ontario (CA)

( * ) Notice: Subject to any disclaimer, the term of this patent is extended or adjusted under 35 U.S.C. 154(b) by 0 days.

(21) Appl. No.: 09/414,069

(22) Filed: Oct. 7, 1999

(51) Int. Cl.[7] ..... E04C 2/54
(52) U.S. Cl. ..... 52/786.13; 52/786.1
(58) Field of Search ..... 52/786.1, 786.11, 52/786.13; 428/34; 156/107

(56) References Cited

U.S. PATENT DOCUMENTS

| | | | |
|---|---|---|---|
| 2,993,242 A | | 7/1961 | Leisibach |
| 3,008,196 A | * | 11/1961 | Springer et al. |
| 4,207,869 A | | 6/1980 | Hart |
| 4,459,789 A | | 7/1984 | Ford |
| 4,464,874 A | | 8/1984 | Shea, Jr. et al. |
| 4,552,790 A | | 11/1985 | Francis |
| 4,564,540 A | | 1/1986 | Davies et al. |
| 4,608,796 A | | 9/1986 | Shea, Jr. |
| 4,753,056 A | | 6/1988 | Pacca |
| 4,791,762 A | | 12/1988 | Hwang |
| 4,831,799 A | | 5/1989 | Glover et al. |
| 4,994,309 A | | 2/1991 | Reichert et al. |
| 5,097,642 A | | 3/1992 | Richardson et al. |
| 5,177,916 A | | 1/1993 | Misera et al. |
| 5,494,715 A | | 2/1996 | Glover |
| 5,544,454 A | | 8/1996 | Richardson et al. |
| 5,653,073 A | | 8/1997 | Palmer |

FOREIGN PATENT DOCUMENTS

| | | |
|---|---|---|
| DE | 25 27 013 | 1/1976 |
| DE | 89 01 593 | 3/1989 |
| DE | 40 07 365 | 9/1991 |
| EP | 0 328 823 | 8/1989 |
| FR | 1459169 | 2/1967 |
| FR | 2 653 470 | 4/1991 |
| FR | 2 708 030 | 1/1995 |
| WO | 91/08366 | 6/1991 |
| WO | 98/25001 | 6/1998 |
| WO | 99/14169 | 3/1999 |

OTHER PUBLICATIONS

Inter Glass Metal '97, "Extreme Perfomance Warm–Edge Technology and Integrated IG/Window Production Systems"; Michael Glover, Technical Director, Edgetech IG; Sep. 1997.

* cited by examiner

*Primary Examiner*—Milton Nelson, Jr.
(74) *Attorney, Agent, or Firm*—Wenderoth, Lind & Ponack, L.L.P.

(57) ABSTRACT

A fenestration sealed frame insulating glazing panel has an integral planar frame formed by four rigid plastic profiles interconnected end-to-end to define corners, the profiles having a low heat conductivity. Two glazing sheets are arranged in spaced parallel relationship attached on opposite sides of the frame in rigid manner by thermosetting adhesive to form an integral structure having an insulating cavity enclosed by the frame. The front face of each frame profile presented towards the cavity is covered by a low permeability sealant. The sealed frame glazing panel can include a third glazing sheet positioned in parallel between the first two glazing sheets and likewise interconnected at its perimeter to the frame to divide the insulating cavity into two parallel coextensive sub-cavities. The profiles of the frame can be made from structural plastic foam material, glass fiber, oriented thermoplastic, or various other materials of low thermal conductivity. The glazing panel can be incorporated as a fixed window or as an operating window or door in an external building wall.

30 Claims, 23 Drawing Sheets

FENESTRATION SEALED FRAME, INSULATING GLAZING PANELS

BACKGROUND OF THE INVENTION

1. Field of the Invention

This invention relates generally to glazing-and-frame construction and more particularly to fenestration sealed frame, insulating glazing panels.

2. Description of the Prior Art

A conventional window consists of an insulating glass unit supported within a separate frame. Traditionally, the frame was made from wood or metal profiles but increasingly plastic profiles are being substituted made from such materials as polyvinyl chloride (PVC) or pultruded fibreglass.

A traditional insulating glass unit generally consists of two or more glass sheets that are typically separated by a hollow aluminum spacer bar that is filled with desiccant bead material. With a conventional dual-seal unit, thermoplastic polyisobutylene material is applied to the spacer sides and the outward facing channel between the glazing sheets and the spacer is filled with structural thermosetting sealant.

Because of the high thermal conductivity of the aluminum spacer, various efforts have been made in recent years to manufacture the hollow spacer from a rigid low conductive plastic material. U.S. Pat. No. 4,564,540 issued to Davies describes the substitution of a rigid hollow fibreglass pultrusion for the aluminum spacer. Although a substantial development effort was carried out, this product has not yet been successfully commercialized, and technical problems include: moisture wicking at the corners; glass stress breakage, and poor argon gas retention.

One solution to the problem of glass stress breakage to manufacture the spacer from flexible material. U.S. Pat. No. 4,831,799 issued to Glover et al describes a flexible rubber foam spacer that is desiccant filled with pre-applied pressure sensitive adhesive on the spacer sides. This flexible foam spacer has been commercialized under the name of Super Spacer®. In addition to featuring a low conductive spacer, another innovative feature of a Super Spacer® edge seal is that the traditional roles of the two perimeter seals are reversed. The inner PSA seal is the structural seal while the outer seal is the moisture/gas barrier seal that is typically produced using hot melt butyl sealant.

In the past ten years, other warm-edge technologies have been developed where the traditional aluminum spacer has been replaced by a spacer made from a more insulating material and where there is also a flexible edge seal design. These other warm-edge technologies include: PPG's Intercept® and AFG's Comfort Seal® product. In total, these flexible warm-edge technologies have now gained about a 80 per cent share of the North American market.

In addition to reducing perimeter heat loss, these new warm edge products also improve the efficiency and the speed of manufacturing the insulating glass units. These system improvements include: manufacturing the edge seal as a metal re-enforced butyl strip (Tremco's Swiggle Seal®); roll forming the spacer and incorporating butyl desiccant matrix and an outer butyl sealant (PPG's Intercept®); and manufacturing the spacer from EPDM foam with pre-applied butyl sealant and desiccant matrix (AFG's Comfort Seal®). Although these improvements allow for the automated production of insulating glass units, residential sash windows still tend to be manufactured using largely manual assembly methods and typically, window frame fabrication is more labor intensive than sealed unit production.

One way of improving window production productivity is to fully integrate frame and sealed unit assembly. In the presentation notes for the talk entitled *Extreme Performance Warm-Edge Technology and Integrated IG/Window Productions Systems given at InterGlass Metal* '97, Glover describes a PVC sealed frame window system developed by Meeth Fenester in Germany. With this system, there is one continuous IG/window production line and using an automated four point welder, a PVC window frame is assembled around a double glazed unit. As noted in the paper, some of the concerns with the Meeth system include: problem of broken glass replacement; recycling/disposal of PVC window frames, and the technical risks of no drainage holes.

SUMMARY OF THE INVENTION

The present invention provides a fenestration sealed frame insulating glazing panel having an integral generally planar frame that is formed by a number of rigid plastic profiles having interconnected ends that define corners of said frame, said plastic profiles being fabricated in a material that has a low heat conductivity compared to aluminum and a coefficient of expansion that is similar to that of glass; two glazing sheets arranged in spaced parallel relationship and attached to opposite sides of said frame to define therewith a sealed insulating cavity; each framing profile in section having a portion that is overlapped by said sheet, said overlapped portion of each framing profile defining on opposite sides thereof an elongate seat to receive a marginal edge region of a corresponding one of said glazing sheets; each said framing profile having a front face that is located between said elongate seats and is directed into said cavity; said glazing sheets being adhered to said seats by a structural sealant material that exhibits thermosetting properties; a low permeability sealant covering the front face of each of said frame profiles and extending towards the structural sealant on opposite sides of each framing profile to provide a continuous seal between said glazing sheets around the periphery of said cavity.

The low permeability sealant that is exposed to the interior of the cavity can incorporate desiccant material.

Preferably there is a decorative strip provided around the perimeter of each glazing sheet to cover or mask the structural sealant.

The rigid plastic profiles can be provided in many different forms, e.g. as glass fiber pultrusions, oriented thermoplastic profiles, or structural plastic foam profiles. Whatever material is used in these rigid plastic profiles, it should have a heat conductivity that is low compared to aluminum. Preferably the heat conductivity would be less than 1/100 that of aluminum. For example whereas the thermal conductivity of aluminum is 160 W/m° C., the thermal conductivity of glass fibre is 0.3 W/m° C., and that of expanded polystyrene foam is 0.03 W/m° C.

A vapor barrier sheet film material can be applied to the front face of each framing profile, and the low permeability sealants may be hot melt butyl or polyisobutylene.

The structural sealant is preferably made from thermosetting silicone material, and an alternative preferred material option is for the structural sealant and the low permeability sealant to be a single material that has both thermoplastic and thermosetting properties, for example in modified silicone material or a modified polyurethane material.

A third glazing sheet can be positioned between the two outer glazing sheets and this third glazing sheet which is the same shape but smaller in size than the outer glazing sheets can either be directly adhered to a stepped frame profile or adhered to either one or both glazing sheets by means of flexible foam spacers.

The fenestration sealed frame insulating glazing panel of the invention may be utilized as a door or a window panel in an exterior building wall. Where the panel is mounted to be moveable, suitable operating devices are attached to the plastic frame for connection to an operating mechanism in the window or door frame in the building wall. When used as a window, the glazing panel is preferably mounted in overlapping relationship to an opening in the wall of the exterior side thereof.

In an alternative configuration the glazing panel in accordance with the invention may be utilized to provide ribbon windows in a building wall. In this arrangement, each panel is positioned so that it spans between top and bottom supports, the side edges of adjacent panels being in abutment but otherwise being unsupported.

The fenestration sealed frame glazing insulating panel of the present invention is self supporting and may be designed to carry structural loads, in this case the glazing sheets being made of laminated glass. In such a stressed skin structural panel, the glazing sheets are preferably spaced apart by at least about 70 mm, and the panel can incorporate a passage through which air can enter and leave the interior cavity, such passage incorporating desiccant to remove moisture from air that enters the cavity between the sheets.

BRIEF DESCRIPTION OF DRAWINGS

The following is a description by way of example of certain embodiments of the present invention, reference being made to the accompanying drawings, in which.

DETAILED DESCRIPTION OF DRAWINGS

Figure 1:
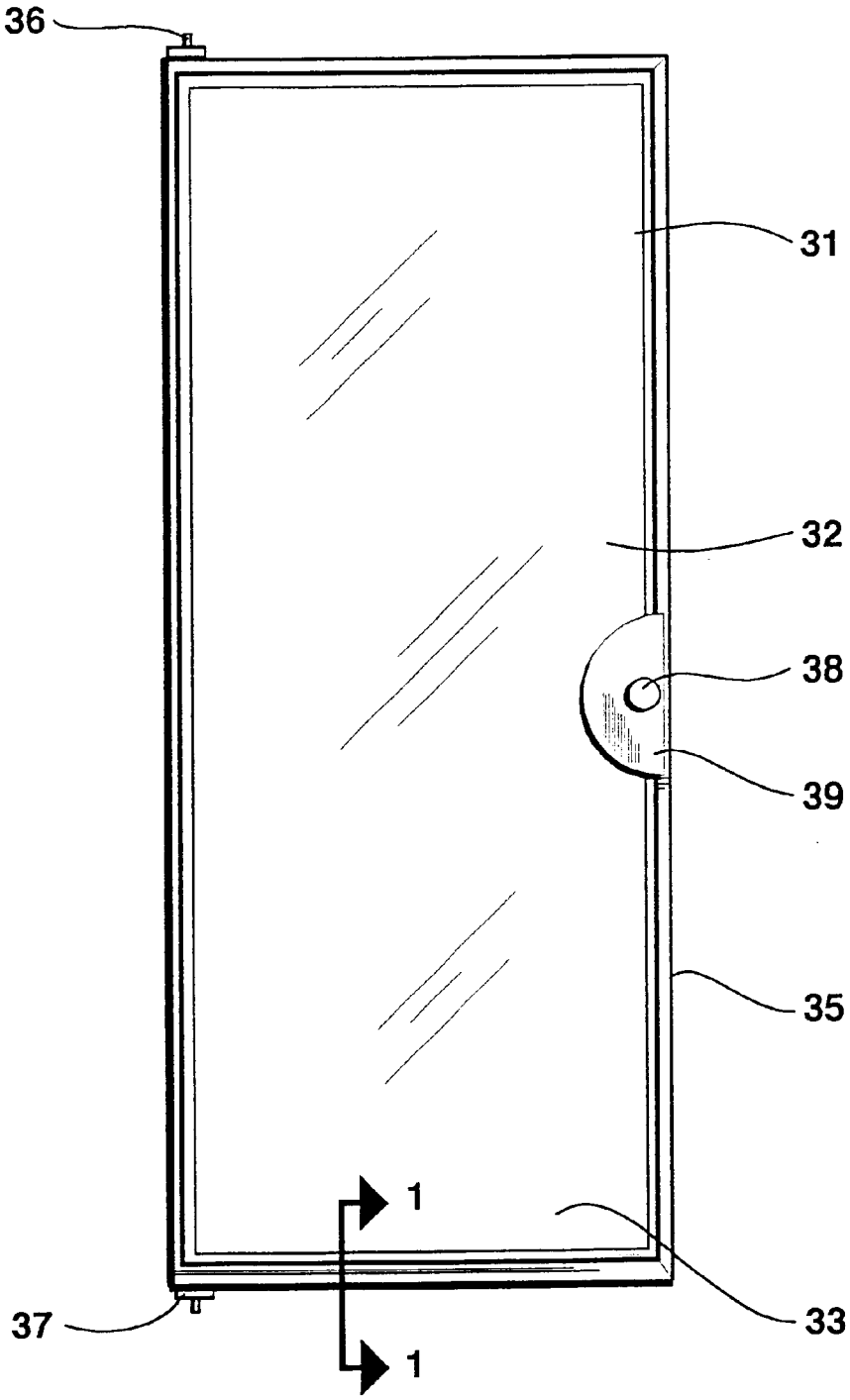
FIG. 1. shows an elevation view of an exterior sealed frame, double glazed door panel.

Referring to the drawings, FIG. 1 shows an elevation view of a sealed frame, double glazed panel 31 that functions as an operable exterior door 32. The glazing door panel 31 consists of two glazing sheets 33 and 34 (not shown) that are adhered to a perimeter frame 35. The panel 31 is supported top and bottom on pivot hinges 36 and 37. The handle and locking mechanism 38 for the operable door 32 are incorporated in a half circular panel 39 that forms part of the outer perimeter frame 35. The glazing door panels are typically made from heat strengthened or tempered glass sheets although rigid clear plastic sheets can be substituted.

Figure 2:
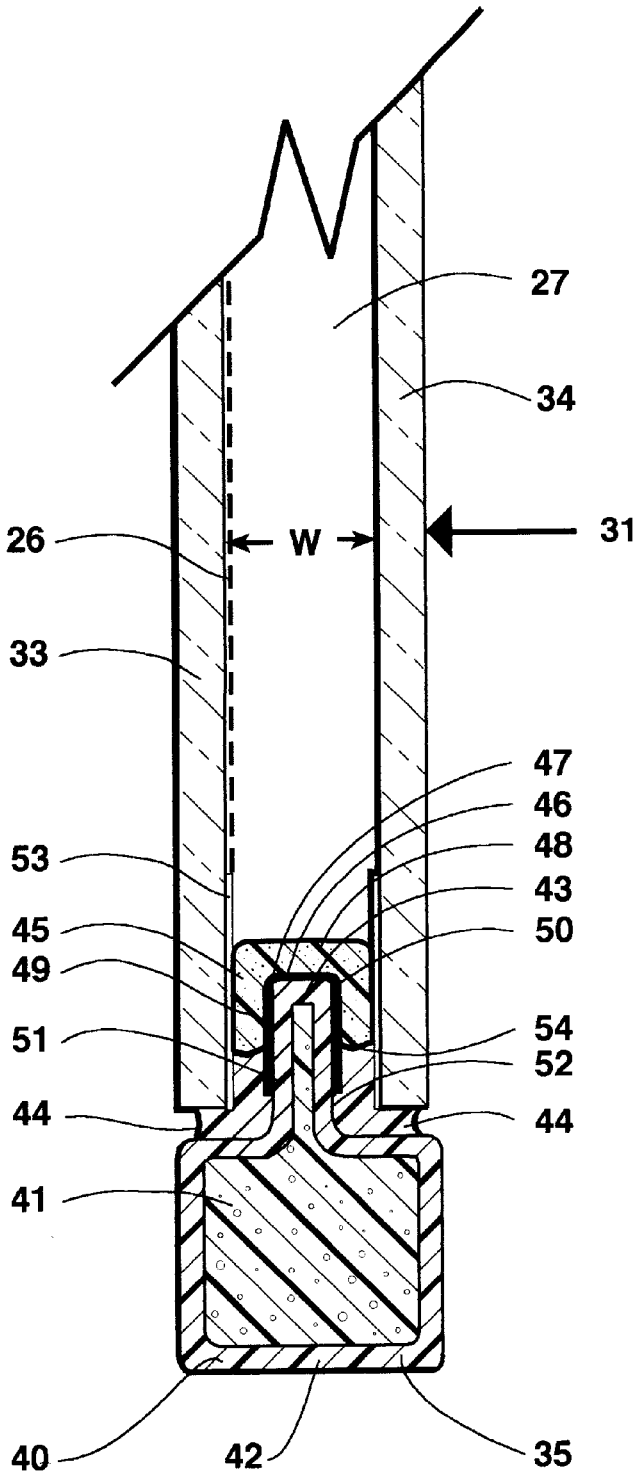
FIG. 2. shows a cross-section on a line 1—1 through an exterior sealed frame, double glazed door panel made from pultruded fibre glass profiles.

Various plastic materials can be used for fabricating the perimeter frame profile 35 shown in FIG. 2. One preferred plastic material is a pultruded fibreglass profile, which is a very rigid and stiff material that offers good screw holding potential. A second preferred profile material is oriented thermoplastic material such as polyethylene or polypropylene. A third preferred material is a glass fibre re-enforced, structural foam plastic profile fabricated from materials such as polycarbonate or polyimides. In all three cases, the plastic material has a co-efficient of expansion similar to glass and this helps ensure that there is minimum differential expansion between the glass sheets and the rigid plastic profiles.

Also compared to aluminum and other metals, all three plastic materials options have a comparatively low thermal conductivity. For example in the case of fibre glass, the thermal conductivity is 0.3 W/m° C. while in comparison the thermal conductivity of aluminum is 160 W/m °C. However compared to fibre glass, the thermal conductivity of other plastic materials are much lower and for example, the thermal conductivity of expanded polystyrene foam is 0.03 W/m°° C.

FIG. 2 shows a cross section 1—1 of the sealed frame double glazing panel 31. The glazing sheets 33 and 34 are typically made from heat strengthened or tempered glass. The thickness of the glazing sheets is selected to suit the specific application. For residential use a glass thickness of 3 mm is normally preferred and for commercial use a thickness of 6 mm.

The cavity spacing W between the glazing sheets varies depending on the fenestration panel size. For smaller, residential windows, the cavity width is typically 12.5 mm while for larger door panels where there is a need for increased stiffness and rigidity, the cavity width can be increased to 30 mm. With these larger glazing cavity widths, there is the problem of increased heat loss due to increased convective flows and one way of reducing these cavity flows is by incorporating an additional third glazing sheet.

Figure 7:
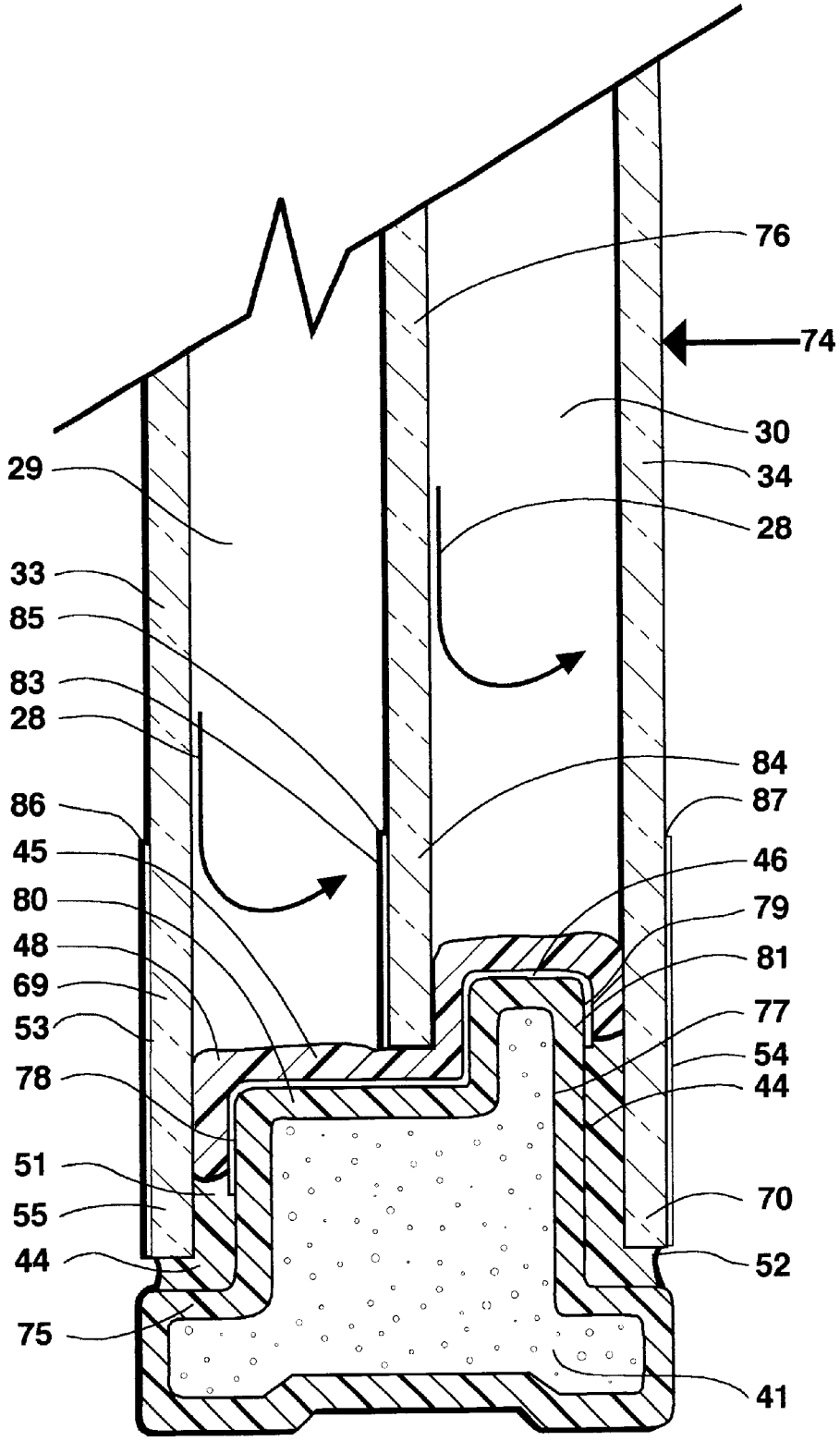
FIG. 7. shows a cross section through a sealed frame, triple glazed door panel incorporating a stepped frame profile.
Figure 8:
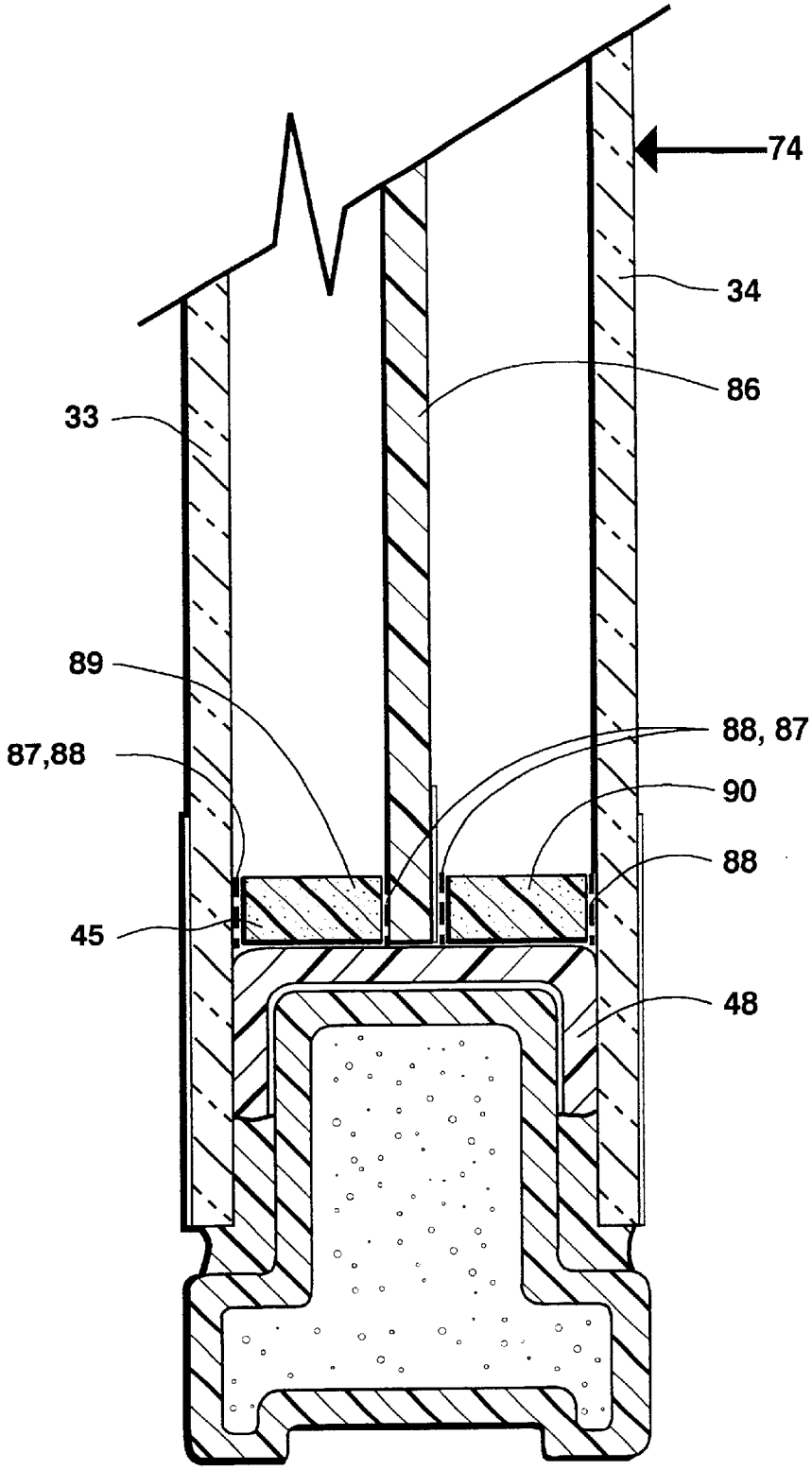
FIG. 8. shows a cross section through a sealed frame, triple glazed door panel where the center glazing is held in position by two flexible desiccant filled foam spacers.
Figure 9:
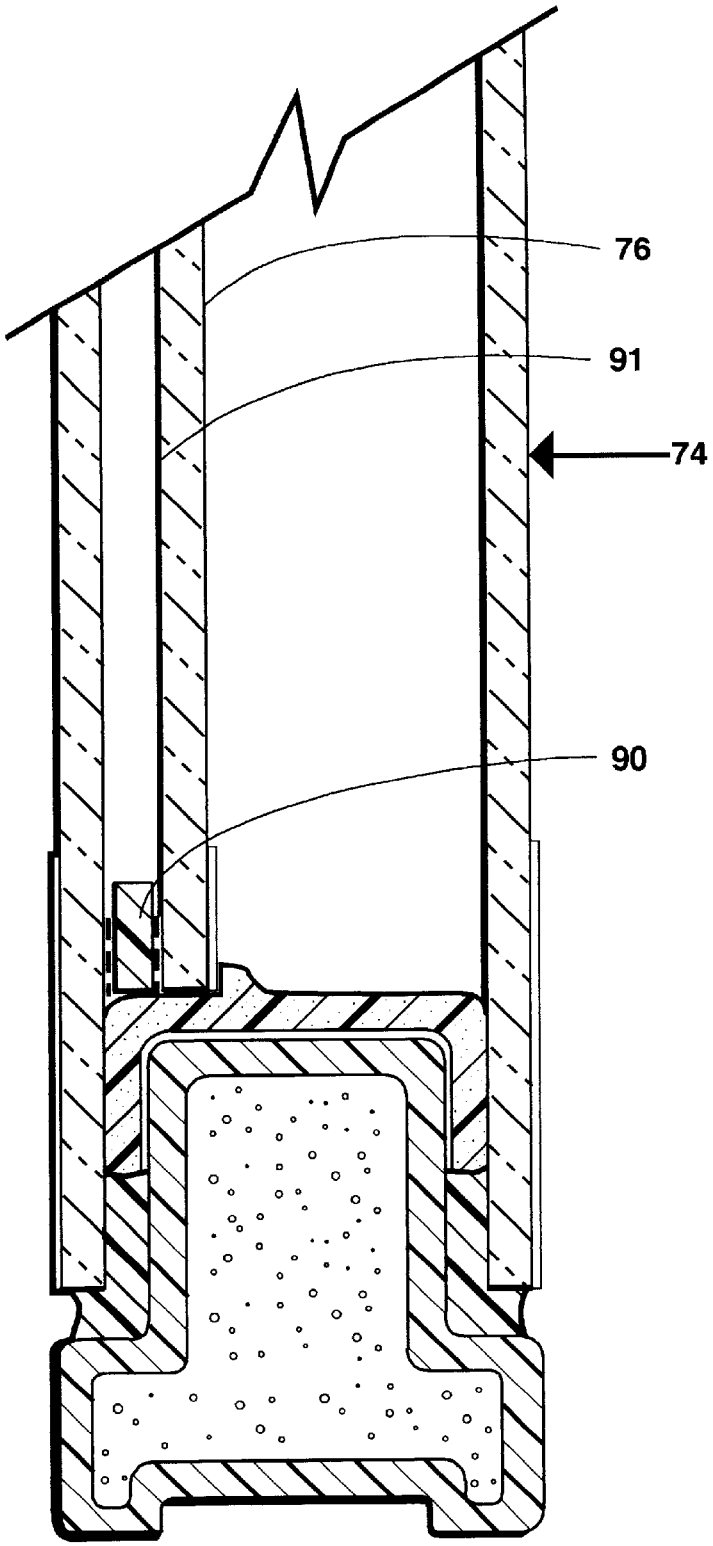
FIG. 9. shows a cross section through a sealed frame, triple glazed door panel where the center glazing is held in position by a single flexible foam spacer.

To illustrate alternative edge seal material options, FIGS. 2 to 6 show the simpler configuration of a double glazed unit. While alternative assembly methods for the more complex triple glazed units are illustrated in FIGS. 7 to 9. Although the alternative edge seal material options are only shown for double glazed units, it can be appreciated by those skilled-in-the-art that these alternative materials can also be used for the more complex triple-glazed units.

In FIG. 2, the plastic frame profile 40 is made from pultruded fibre glass and for reduced heat loss, the hollow profile 40 is filled with light weight, insulating plastic foam 41. The hollow profile 40 consists of a main body 42 and an extended tongue 43. A barrier film 46 is typically pre-applied to the front face 47 and top side edges 49 and 50. The barrier film 46 can be laminated and adhered to the glass fibre profile using pressure sensitive adhesives or alternatively, the barrier film can be applied during the pultrusion process and this has the advantage that the film can be coated with a thin layer of polyester material which helps ensure that the film cannot be accidently damaged or punctured prior to the assembly of the sealed frame panel.

The glazing sheets 33 and 34 overlap the tongue (or overlap portion) 43 and are adhered to the framing profile with structural thermosetting sealant 44 that is applied to the bottom portions of 51, 52 of the extended tongue 43. Low permeable sealant 48 is applied on top of the barrier film 46 to form a cavity perimeter seal. As shown in FIG. 2, an L-shaped elongate seat is defined on each side of the tongue 43 so as to have a first section parallel to a major surface (i.e. a face) of the associated glazing sheet, and a second section parallel to an edge surface of the associated glazing sheet. The major surface and edge of each glazing sheet are adhered to the first and second sections, respectively, of the associated elongate seat by the sealant 44.

The low permeable sealant 48 must be non-outgassing and preferred materials include hot melt butyl sealant, polyisobutylene and low permeable/thermoplastic thermosetting sealants such as PC 595 and Bostic 9190. To remove moisture vapor from the glazing cavity space 27, the low permeable sealant incorporates desiccant fill material 45 with 3A molecular sieve desiccant being the preferred material.

Low permeable sealant is also applied to the top side edges 49 and 50 of the extended tongue 43. The low permeable sealant on the front and side edges merge at the corners together creating a continuous barrier of sealant material between the glazing sheets 33 and 34.

To hide the perimeter edge-seal, opaque decorative pattern strips 53 and 54 are typically applied around the perimeter edges of the glazing unit. As illustrated in FIG. 2, the decorative pattern consists of ceramic frit material which is applied to the glass sheets 33 and 34 prior to the glass tempering process. At high temperatures during the tempering process, the ceramic frit material fuses to the glass and creates a decorative pattern that is impermeable to moisture vapor.

For improved energy efficiency through reduced radiation heat loss, a low-e coating 26 can be applied to one of the glass cavity surfaces of the glazing panel 31. For reduced conductive/convective heat loss, the cavity space 27 between the glazing sheets 33 and 34 can incorporate a low conductive gas such as argon or krypton.

Figure 3A:
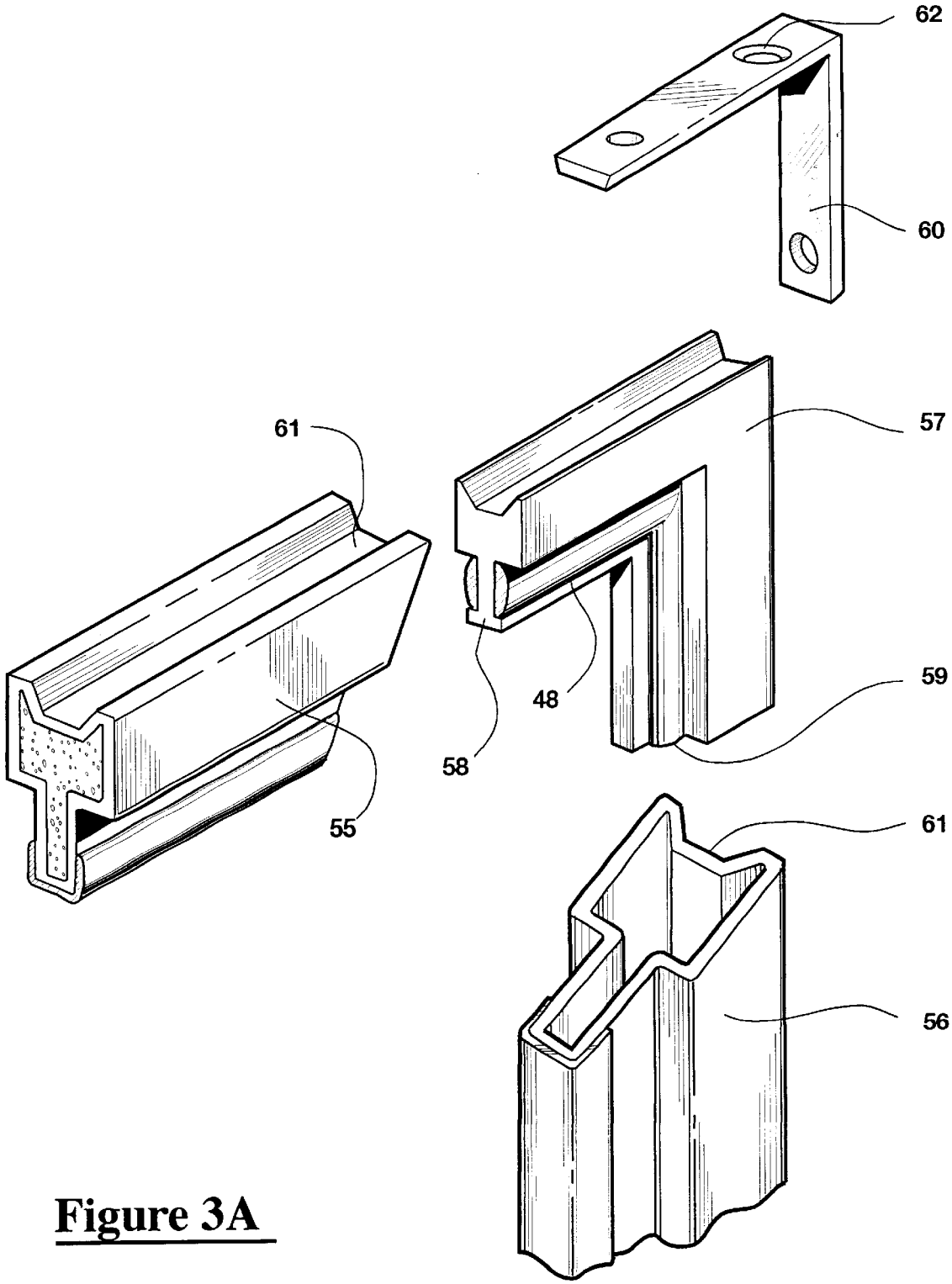
FIG. 3. shows the production steps assembling the exterior sealed frame, double glazed door panel shown in FIG. 2, FIG. 3A. shows an exploded perspective view of the corner key and frame assembly.
FIG. 3B. shows a perspective view of the corner frame assembly with applied sealant and desiccant matrix.
FIG. 3C. shows an exploded perspective view of the corner frame assembly with overlapping glass sheets.

FIG. 3 illustrates the three main production steps involved in the assembly of the sealed frame, double glazed panel illustrated in FIGS. 1 and 2. FIG. 3A shows an exploded perspective corner view of two hollow plastic profiles 55 and 56 that have been miter cut and are joined together with a tight fitting corner key 57. The tongue 58 of the corner key 57 incorporates a groove 59 which is filled with low permeable sealant material 59 that adhesively bonds to the profiles 55 and 56. For additional corner rigidity, a steel metal angle 60 is positioned in an outer channel 61 and is attached to the framing profiles 55 and 56 using screws or other mechanical fixing devices. The corner metal angle 60 incorporates a connection point 62 for attaching the operating door hardware such as pivot hinges.

Figure 3B:
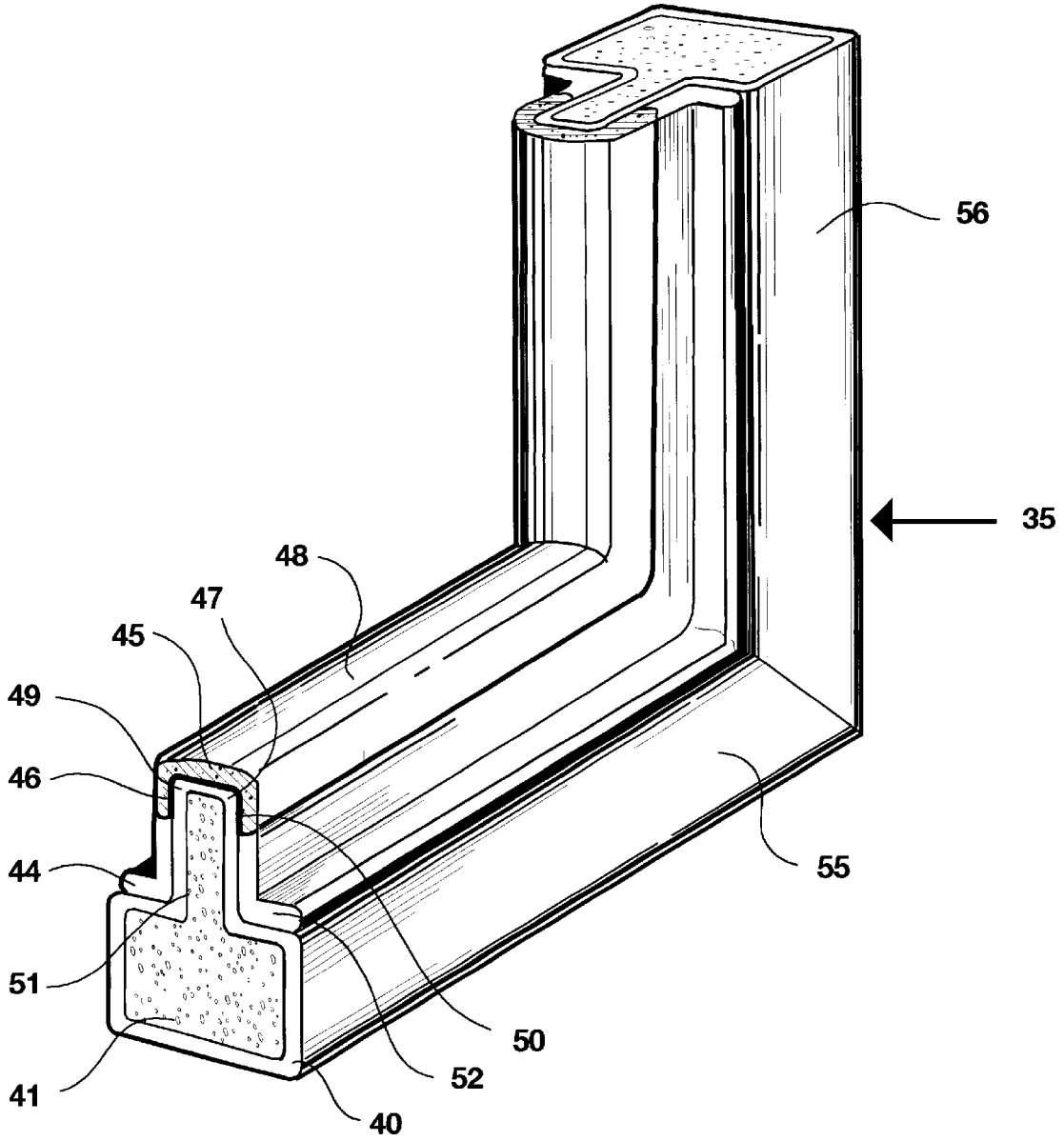

FIG. 3B shows a perspective view of the corner frame assembly where sealant is applied to the hollow profiles 55 and 56. Low permeable sealant 48 is applied to the front face 47 and the top side edges 49 and 50 and structural sealant is applied to the neck portions 51 and 52 of the hollow fibreglass profiles 55 and 56. Typically to ensure even application both sealants are simultaneously applied using special gunning heads that automatically follow around the inner perimeter edges of the four sided framing assembly 35.

Figure 3C:
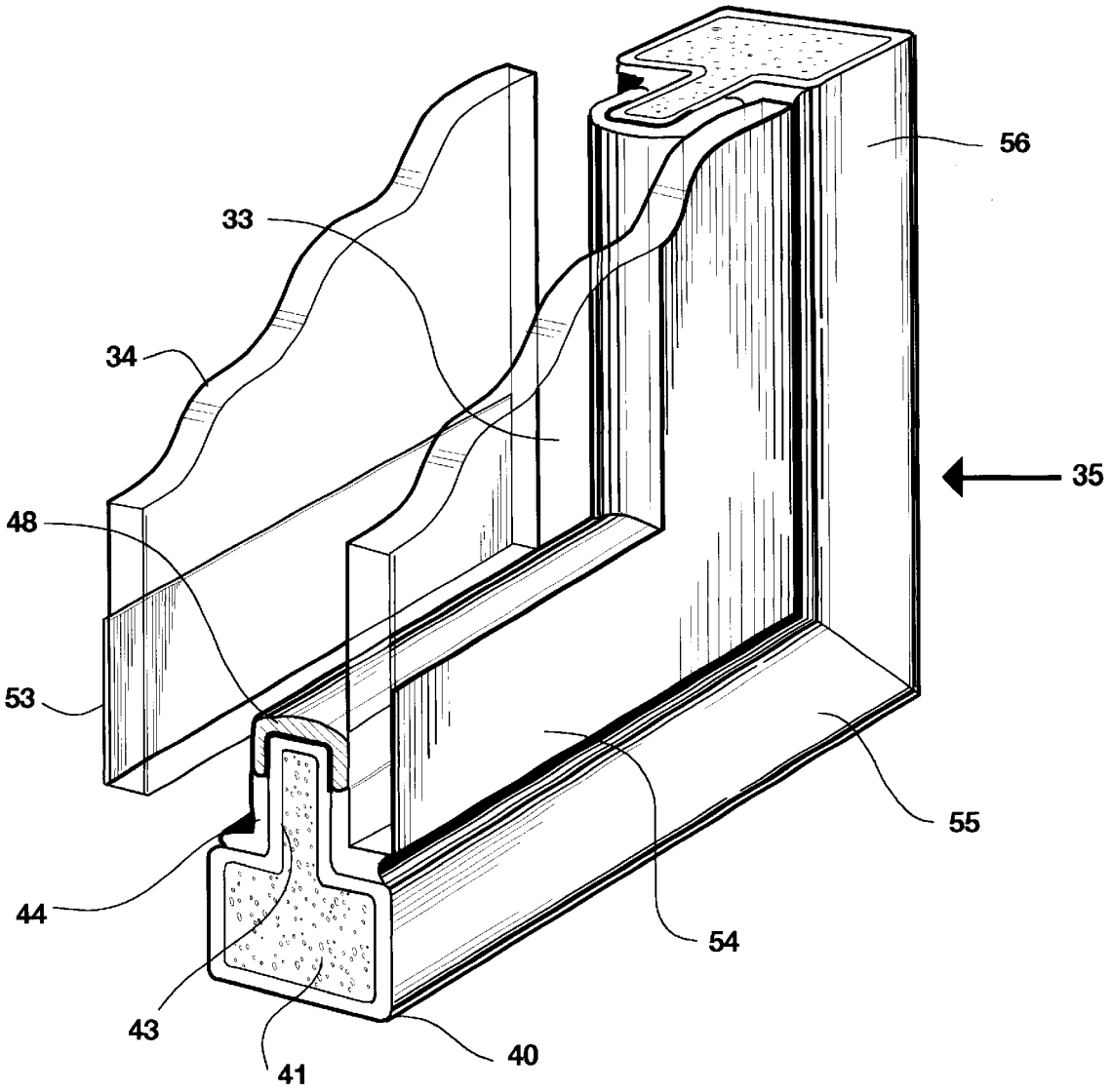

FIG. 3C shows a partially exploded view of the corner frame assembly where a first glazing sheet 33 is matched with the frame assembly 35. The glazing sheet 33 overlaps the extended tongue portion 43 of the framing profiles 55 and 56.

Typically the glazing sheets are assembled using automated insulating glass matching equipment that is specially modified to allow for the different frame profile shapes. After the glazing sheets 33 and 34 have been accurately matched, the low permeable sealant 48 is fully wet out by applying heat and pressure to the sealant material. To allow for different frame profile shapes, the thermosetting sealant 44 is wet out by means of pressure rollers that automatically move around the perimeter edge of the glazing sheets 33 and 34.

Figure 4:
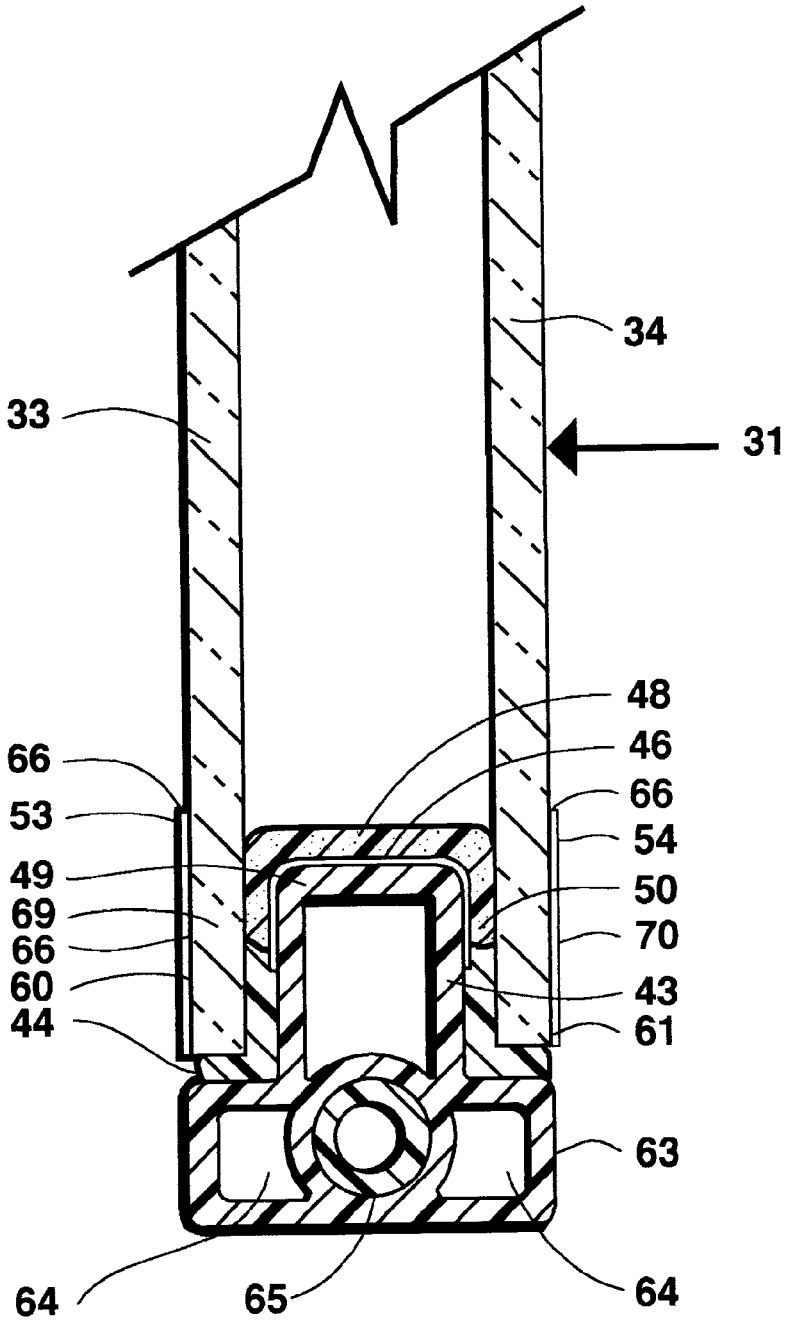
FIG. 4. shows a cross section through a sealed frame, double glazed door panel made from thermoplastic extrusions.

FIG. 4. shows a cross section of a sealed frame, double-glazed, door panel 31 with plastic profiles 63 made from thermoplastic extrusions that are heat welded at the corners. Various thermoplastic materials can be used to produce the frame profiles including fibre filled polyvinyl chloride and oriented polypropylene or polyethylene. Particularly for larger frame assemblies such as doors, the coefficient of expansion of the thermoplastic material should be similar to the thermal coefficient expansion of glass.

The thermoplastic framing profile 63 is subdivided into a series of cavities 64 that help provide improved insulating performance and also provide additional rigidity and strength. The plastic profile 63 can be further re-enforced by a separate re-enforcing profile 65 that can be made from high strength, rigid materials such as steel or pultruded fibreglass. Typically, the operating hardware for the door including the pivot hinges are directly connected to the re-enforcing profile 65.

Decorative strips 53 and 54 are applied on the outer perimeter edges 69 and 70 of the glazing sheets 33 and 34. The decorative strips 53 and 54 can be made from various materials and one preferred material option is polyethylene terephthalate (PET). The strips 53 and 54 are adhered to the outer perimeter edges of the glazing sheets 33 and 34 with acrylic pressure sensitive adhesive 66.

A second preferred option is to produce the strips from a fluoro-elastomer coating. In production, a strip of fluoro-elastomer coated PET film is adhered to the glass using a fluoro-elastomer heat activated adhesive. The PET film is then removed, leaving the fluoro-elastomer coating attached to the glass. For color matching, the exposed outer surfaces of the plastic profile 53 can also be coated with a fluoro-elastomer coating.

Figure 5:
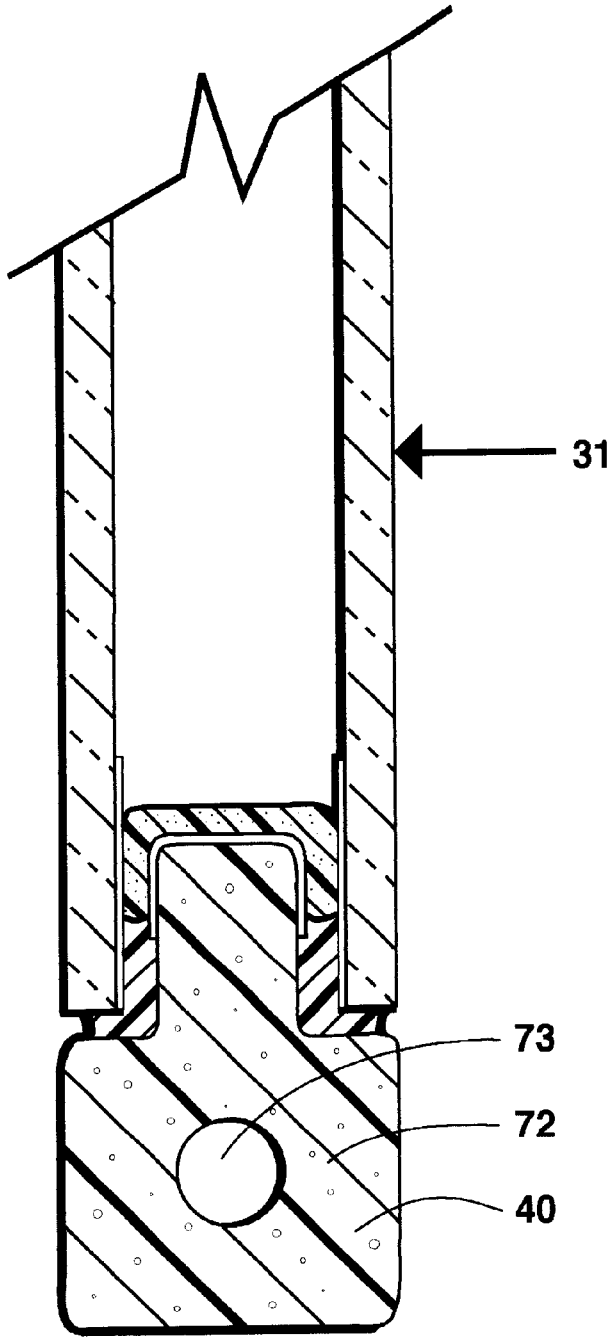
FIG. 5. shows a cross section through a sealed frame, double glazed door panel made from structural foam extrusions.

FIG. 5. shows a cross section of a sealed frame, double glazed door panel 31 made from plastic structural foam profiles 72 that are heat welded at the corners. Various thermal plastics can be used to produce the foam frame profiles including fibre filled polyvinyl chloride foam and fibre filled polycarbonate foam. Particularly for larger frame assemblies such as doors, the coefficient of expansion of the thermoplastic foam material should be similar to the thermal coefficient expansion of glass. To assist in connecting the operating hardware to the structural foam profile 72, the structural plastic foam profile 72 can incorporate a circular cavity opening 73.

Figure 6:
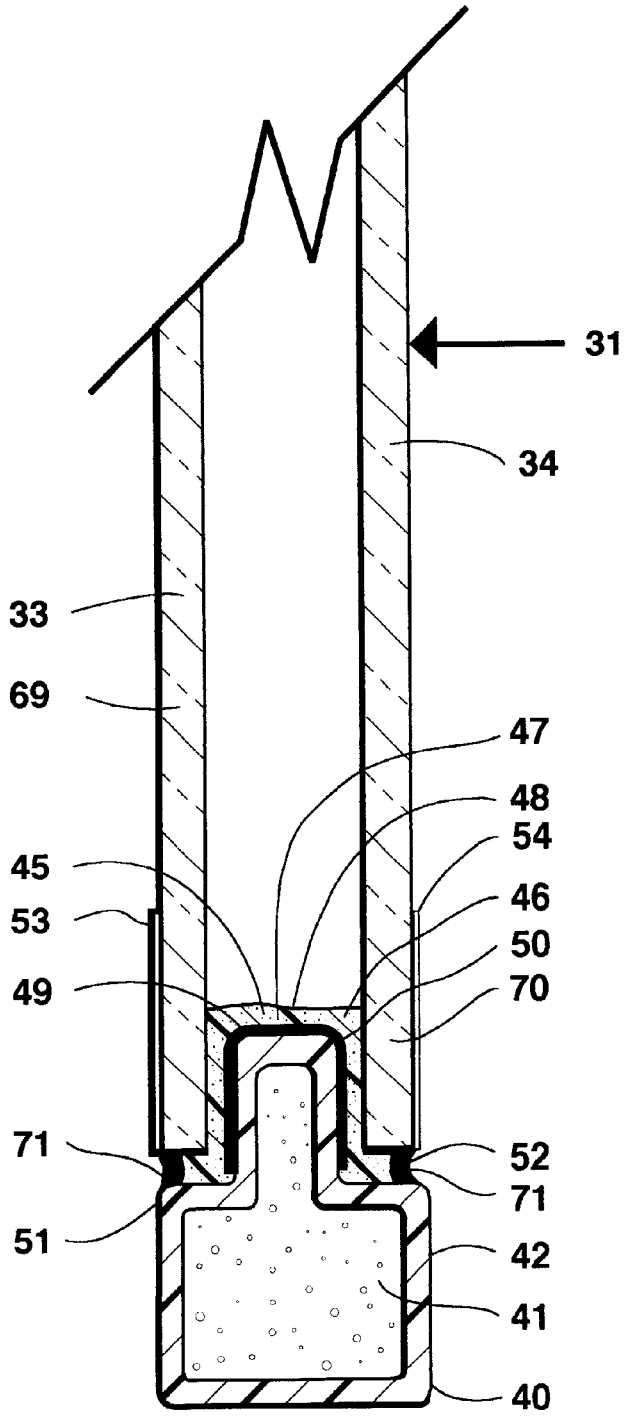
FIG. 6. shows a cross section through a sealed frame, double glazed door panel and where the glazing sheets are held in position using thermoplastic/thermosetting sealant.

FIG. 6. shows a cross-section of a sealed frame, double glazed door panel. A low permeable sealant 48 is applied to the front face 47 of the plastic frame profile 40. The low permeable sealant on the front face 43 incorporates desiccant fill material 45 and low permeable sealant 48 is also applied to the top side edges 49 and 50 of the profile. Low permeable sealant 48 is also applied to the neck portions 51, 52 of the frame and this sealant structurally adheres the glazing sheets 33 and 34 to the frame profile 40. For the low permeable sealant, one preferred material is a specially modified silicone sealant that can be applied as a thermoplastic material but cures as thermosetting material. In contrast to conventional silicone sealant material, the specially modified silicone has a very low permeability that is comparable to hot melt butyl material. One suitable product is PRC 590 or 595 material.

An alternative low permeable, structural sealant is a modified polyurethane sealant such as Bostic 9190. The UV resistance of both the modified silicone and the modified polyurethane sealants is lower than the UV resistance of conventional silicone sealants and so to provide the required protection from UV exposure, there is a need for the decorative strips 53 and 54 to be applied to the perimeter edges 69 and 70 of the glazing sheets 33 and 34.

One preferred option is for the low permeable thermoplastic/thermosetting to also incorporate desiccant fill material and this has the advantage that potentially only one type of sealant material is required and this greatly simplifies the design of the automated sealant glazing equipment. To protect the modified silicone sealant material from direct UV exposure, small rubber beads 71 are inserted in the gaps between the glazing sheets 33 and 34 and the framing profile 40.

FIGS. 7, 8 and 9 show alternative cross section details of a sealed frame, triple glazed door panel featuring a pultruded fibre glass frame.

FIG. 7 shows a sealed frame, triple-glazed door panel 74 with a stepped frame profile 75. Glazing sheets 33 and 34 overlap the stepped-frame profile 75. A third glazing sheet 76 is located between two outer glazing sheets 33 and 34 and this third glazing sheet 76 is similar in shape but smaller in size than the center two glazing sheets 33 and 34. A barrier film 46 is laminated to the stepped profile and the film 46 extends from the two side edges 78 and 79 and across the two front faces 80 and 81. The barrier film 46 is also laminated to a tongue shaped portion 77 located between the glazing sheets 76 and 34. Low permeable sealant 48 is applied continuously to the barrier film 46 and this low permeable sealant 48 incorporates desiccant fill material 45. Structural thermosetting sealant material 44 is applied to the bottom neck portions 51 and 52 of the stepped profile 75.

In assembly, the sealed frame, triple glazed door panel 74, the center glazing panel 76 is positioned against the tongue portion 77 and by using special automated glass matching equipment, the glazing sheet 76 can be very accurately located so that the low permeable sealant 48 on the front face 80 is not disturbed and the integrity of the barrier seal is maintained. Decorative plastic film strips 53 and 54 are pre-applied to the perimeter edges 69 and 70 of the glazing sheets 33 and 34. Typically the decorative strips are made from dual tone material with the inner surface being colored black while the outer surface is typically white or another contrasting color.

An additional strip 83 is applied to the perimeter edge 84 of the center glazing sheet 76 and the outward surface 83 is typically a dark color such as black. The top edge 85 of the decorative strip 83 is lined up with the top edges 86 and 87 of the outer entire decorative strips 53 and 54. When viewed at the oblique angle, the dark colored surfaces visually merge together creating the visual illusion of a solid profile and as a result, the stepped portion of the frame is not visually noticeable.

For sealed frame, triple glazed panels, one major advantage of the stepped frame profile is improved condensation resistance. The bottom edge cold air convection currents 28 within the outer glazing cavity 29 do not coincide with the bottom edge cold air convection currents 28 within the inner glazing cavity 30 and as a result, the bottom edge glazing temperatures can be quite significantly increased. Particularly for freezer doors, this increase in bottom edge temperature is important as it potentially allows for the complete elimination of perimeter edge heating systems.

FIG. 8 shows a sealed frame, triple glazed door panel 74 where the center glazing is a rigid transparent plastic sheet 86. In comparison with conventional triple glazing, the advantage of using a rigid plastic center glazing is that it provides for improved security protection and hurricane resistance. The plastic sheet can be made from various materials including polycarbonate and acrylic. The plastic sheet 86 is adhered to the outer glass sheet 33 using a flexible foam spacer 89 that feature pre-applied pressure sensitive side adhesive 87 on the spacer sides 88. A second flexible foam spacer 90 is adhered to the inner glass sheet 34 and the three glazing sheets 33, 86 and 34 are accurately matched together so that the plastic sheet 80 is suspended between the two outer glazing sheets 33 and 34. The advantage of using flexible foam spacers 89 and 90 is that differential expansion between the rigid plastic sheet 86 and the glass sheets 33 and 34 can be easily accommodated. The pressure sensitive adhesive must be non-out gassing and one suitable material option is acrylic. The spacers 89 and 90 can be manufactured from flexible foam material. Suitable materials including silicone or EPDM rubber that must also be specially formulated so that it is non-out gassing.

One option is for the flexible foam spacers 89 and 90 to incorporate desiccant fill material 45 and so if sufficient desiccant material is incorporated with the flexible foam spacers 89 and 90, there is no need to incorporate desiccant fill material 45 within the low permeable sealant 48.

FIG. 9 shows a sealed frame, triple glazed door panel 74 where a flexible plastic film 91 is laminated to the center glazing sheet 76. Using a pressure sensitive adhesive such as acrylic. The addition of the flexible plastic film provides for enhanced security protection and hurricane resistance. As well, an additional advantage is that decorative patterns can be pre-printed on the flexible film 91 and then laminated on the glazing sheet 76.

FIGS. 2 to 9 show alternative perimeter edge details of sealed frame, insulating glazing panel construction for glass entrance doors. This type of sealed frame construction can also be used for other door types including: patio doors, swing doors and accordion doors.

As well as creating, a visually attractive all-glass look, the other main advantage of sealed frame, insulating glazing is improved energy efficiency. For a conventional wood frame door incorporating an insulating glass unit, reducing the average perimeter frame width from say 200 mm to less than 35 mm increases glazing area by over 30 per cent and this results in significantly increased solar gains and energy efficiency. With the Canadian energy rating system, a conventional frame door with a glass IG unit has an energy rating of −17. However a sealed frame, triple glazed door incorporating energy efficient features such as low-e coatings and argon gas fill can have an energy rating as high as +10.

Figure 10:
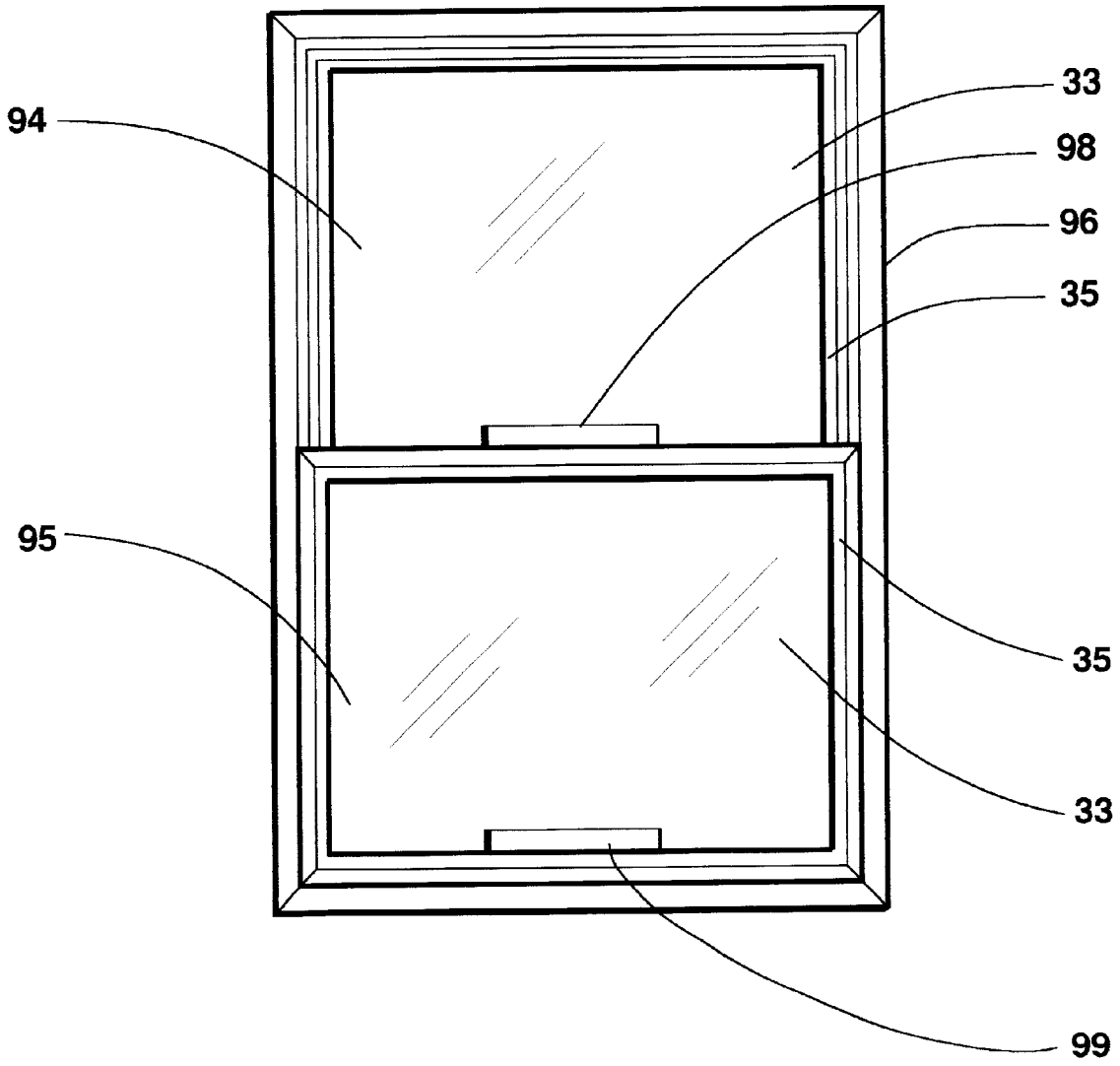
FIG. 10. shows an elevation view of a sealed frame, double glazed vertical sliding window.

In addition to glazed doors, sealed frame insulating glazing panel construction also offers performance advantages for fixed and operable windows. FIG. 10 shows an elevation view of a vertical sliding window consisting of two sealed frame, insulating glazing panels 94 and 95 incorporated within an outer window frame 96. Each sealed frame, insulating glazing panel is fabricated from two glazing sheets 33 and 34 (not shown) that are adhered to a four sided perimeter frame assembly 35. Although the glazing sheets 33 and 34 can be made from annealed glass, it is preferred for structural and safety reasons if the glass sheets are tempered or heat strengthened. The bottom operable sealed frame glazing panel 95 is connected by means of top corner support pins (not shown) to the balance shoe incorporated within the outer window frame 96. Locking devices 98 and lifting handle 99 are directly attached by screw fixing to the frame assembly 35.

Figure 11:
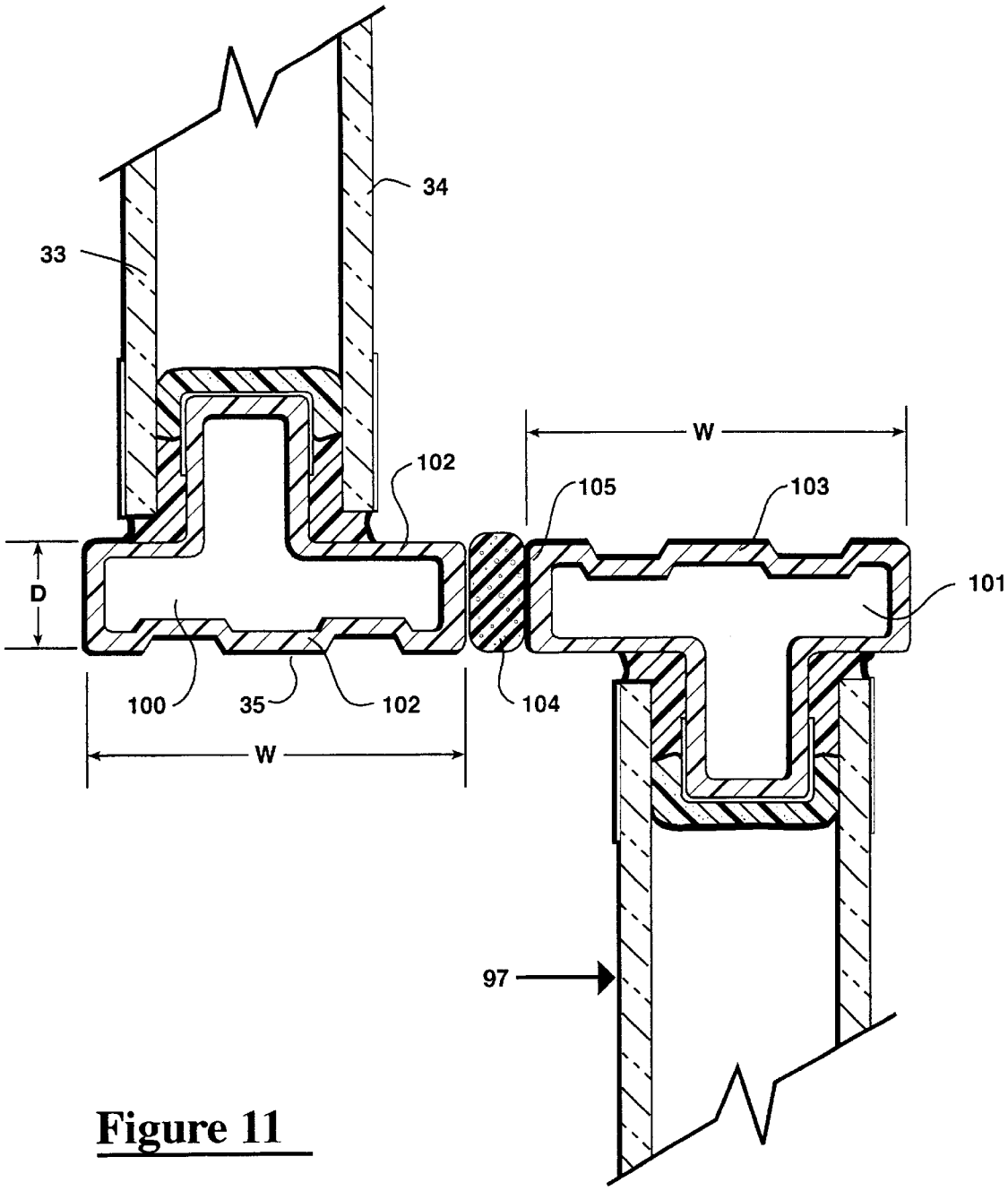
FIG. 11. shows a cross-section of the meeting rail of the vertical sliding window shown in FIG. 10.

FIG. 11 shows a cross section through two meeting rails 100 and 101 of a vertical sliding window 97. The frame profiles or rails 100, 101 are made from pultruded fibre glass and compared to conventional profiles, the frame width W is considerably narrower and for typical small residential windows, the width can be little more than 25 mm. The frame depth D is also considerably less being a little more than 10 mm. This significant reduction in profile size is made feasible because of the inherent stiffness of stressed skin glass panel construction especially when used in combination with the use of very rigid and stiff fibre glass profiles.

As with conventional vertical sliding windows, the frame 35 extends beyond the glazing sheets 33 and 34 creating a ledge 102. The fixed component, and the window locking device 98 is conventionally screw fixed to the ledge 102. While the moveable component is fixed to the top-side 103 of the inside meeting rail frame profile 101. High performance weather stripping 104 is adhered to the side face 105 of the meeting rail frame profile 100. Compared to conventional vertical sliding windows, the advantage of sealed frame, insulating glazing construction is that the perimeter frame depth D is reduced and this allows for increased solar gains and improved energy efficiency.

Figure 12:
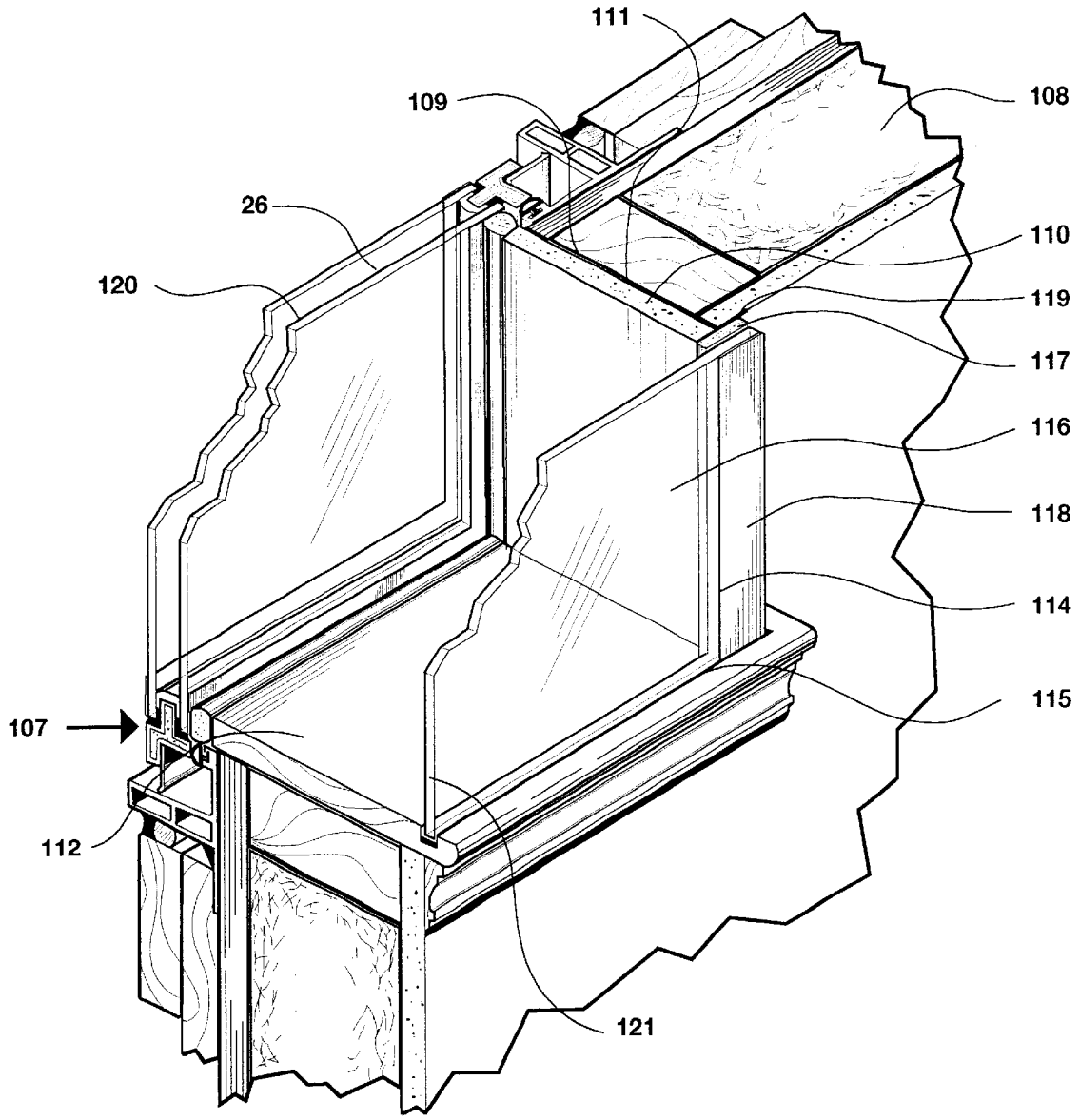
FIG. 12. shows a bottom perspective view of an overlapping sealed frame, double glazed casement window with single glazed interior glazing.

FIG. 12 shows a perspective view of an overlapping window assembly. For increased energy efficiency, a sealed frame glazing casement window 107 is installed on the exterior side of the insulated wood frame building wall 108. The casement window 107 completely overlaps the framed wall opening 109. Dry wall 110 is directly attached to the wood frame members on the side 111 and top of the opening 109. A wood sill 112 is directly attached to the bottom frame member 113. The wood sill 112 incorporates a channel groove 115 and a sheet of tempered glass 116 is supported within the groove. A magnetic flexible rubber gasket 117 is adhered to the perimeter edge 118 of the tempered glass sheet 116. When the interior glass sheet 116 is in position, a seal is created between the flexible rubber magnetic gasket and the buried metal dry wall angle 119. In the summer months when the interior storm glazing panel 114 is removed, there are no visible attachment devices for the tempered glass sheet. Low-e coatings 26 are typically incorporated on surface three 120 and surface five 121 of the triple glazing assembly (surface one is on the exterior). For additional increased energy efficiency, the single tempered glass sheet can be replaced by a double glazed panel assembly.

Compared to conventional triple or quad-glazed windows, the advantage of overlapping window panel construction is increased sound resistance, condensation resistance and energy efficiency. Overlap window construction ensures that solar gains are maximized. For example with the Canadian energy rating system, a double glazed high performance window can have a −10 ER rating while a high performance double, double overlap window can have a +25 ER rating.

Figure 13:
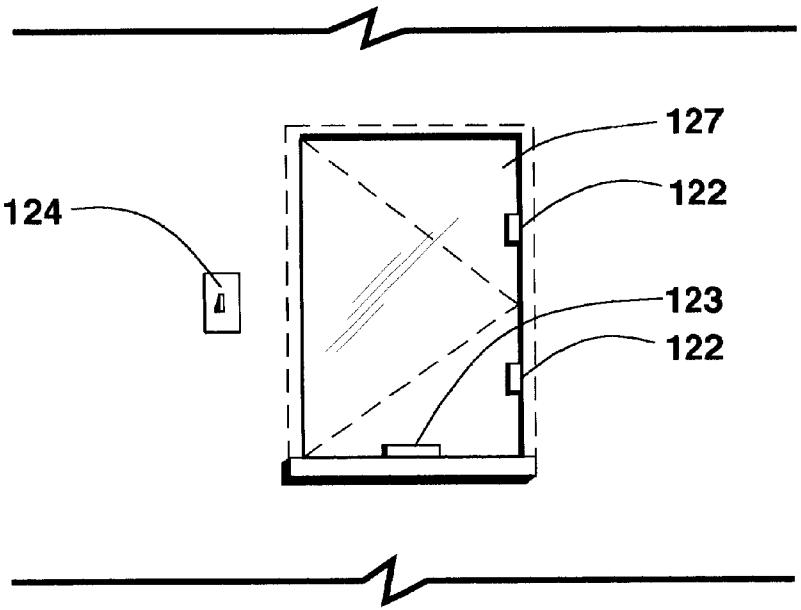
FIG. 13. shows an interior elevation view of an overlapping casement window with the interior glazing removed.

FIG. 13 shows an interior elevation of the overlap window where essentially no window frame is visible. To create this all-glass look, there is a need for special electronic hardware consisting of two motorized locks 122 and motorized opening hardware 123. The electronic hardware system can be operated by a remote control switch 124 or alternatively can be directly tied into a central home automation system and this has the advantage that very sophisticated control procedures can be adopted for both passive solar heating and ventilation cooling. In addition, the electronic hardware system can be tied into the home security system so windows can be automatically closed when the security system is activated.

Figure 14:
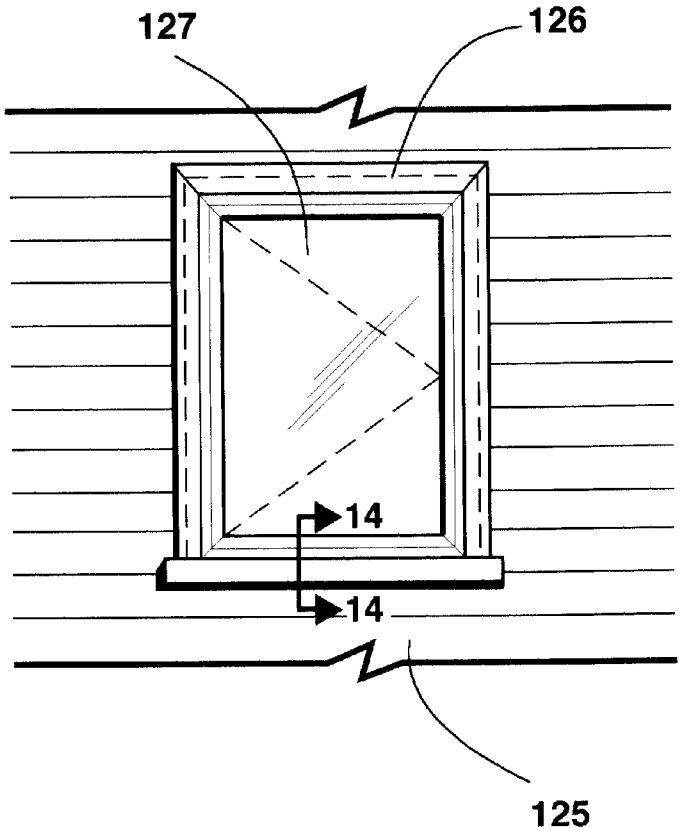
FIG. 14. shows an exterior elevation view of an overlapping casement window.

FIG. 14. shows an exterior elevation view of an overlap window. As illustrated, traditional wood siding 125 is applied as the exterior building wall finish and wood trim 126 is also applied around the perimeter of the overlap window 127.

Figure 15:
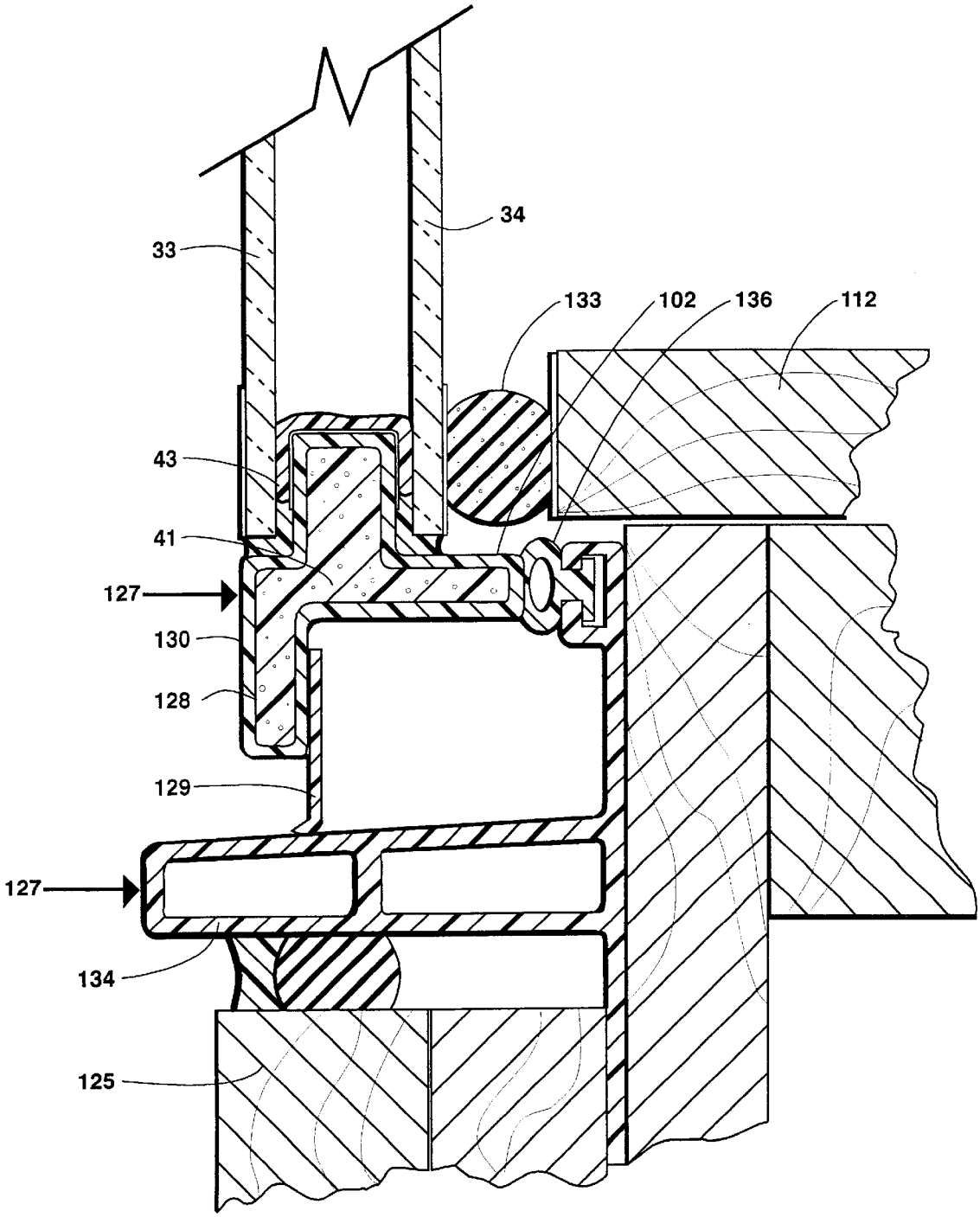
FIG. 15. shows a bottom edge cross-section of an overlapping casement window.

FIG. 15. shows a bottom cross section detail of the outer overlap window 127. The casement sash frame 128 is fabricated from fibre glass pultrusion profiles that are filled with insulating foam 41. Glazing sheets 33 and 34 are adhered to the extended tongue portion 43 of the casement sash frame 128. Bottom and top pivot hinges are connected at the frame corners which are re-enforced with special corner keys (not shown).

The outer rain screen weather stripping 129 is adhered to the bottom leg 130 of the casement sash frame 128. The sash frame 128 extends beyond the interior glazing sheet 34 and hardware keeps are screwed fixed to the ledge 102. For additional insulation a low density EPDM rubber foam extrusion 133 is adhered to the wood cill 112. The main air barrier seal is a conventional EPDM rubber gasket 136. The outer window frame 134 is made from PVC plastic extrusion. Other plastic profile materials such as pultruded fibre glass can be used although the advantage of a PVC profile is that the corners can be thermally welded. The PVC frame 134 is conventionally screwed fixed to the wood frame and the composite wood siding. The bottom leg of the PVC extrusion extends outward for three to six inches and is overlapped by the wood siding 125. As a result, there is no need for separate flashings and window installation is significantly simplified.

Figure 16:
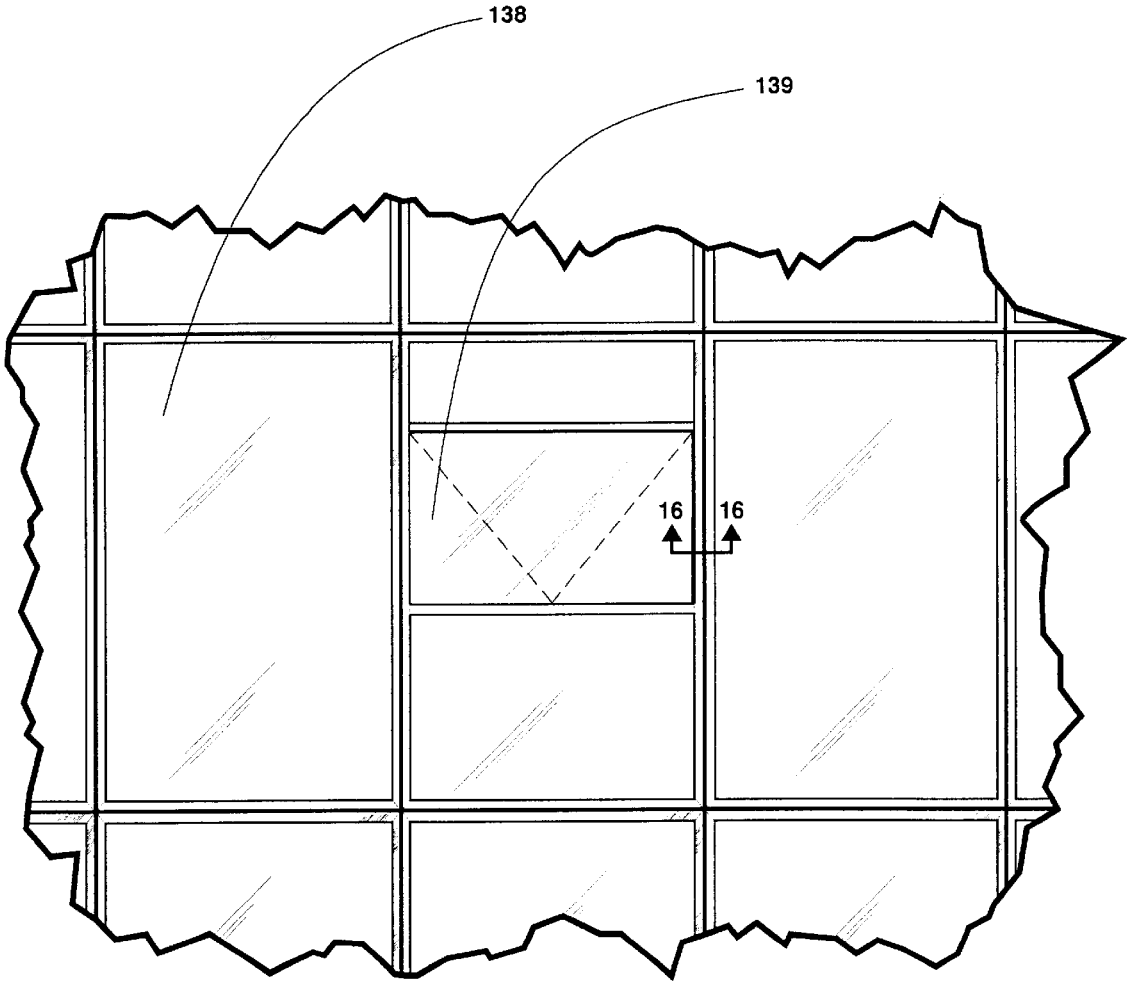
FIG. 16. shows an elevation view of curtain wall glazing featuring an operable awning window.

In addition to residential wood frame construction, overlap window construction with sealed frame, insulating glazing panels also offers advantages for commercial high rise frame buildings. FIG. 16. shows an elevation view of a curtain wall cladding system 138 incorporating an operable window 139. Because of factors such as indoor air quality, energy efficiency and the psychological needs of the building occupants, operable windows are increasingly being incorporated into curtain wall cladding systems. One drawback with operable windows for high rise buildings is the potential adverse effects on HVAC systems operation. However with electronic hardware, these potential adverse HVAC effects can be effectively controlled.

Figure 17:
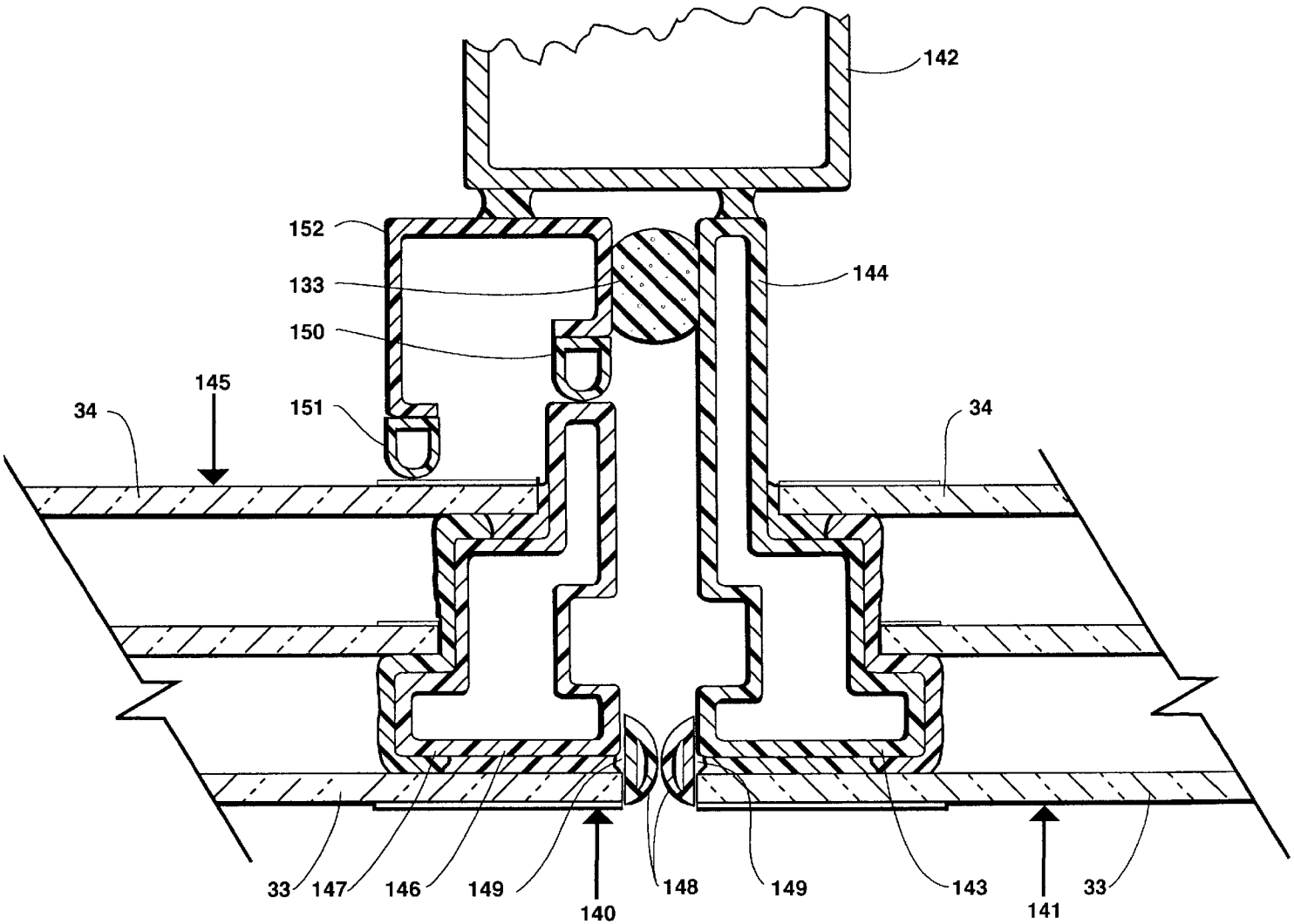
FIG. 17. shows a cross-section side detail of an sealed frame, triple glazed awning window incorporated into a sealed frame, double glazed curtain wall assembly.

FIG. 17. shows a horizontal cross section through the curtain wall assembly 140. A fixed triple glazing panel 141 is connected to the metal support frame 142 by means of metal angle connectors (not shown). The pultruded fibre glass stepped frame profile 143 incorporates a hollow leg extension 144 that extends beyond the interior glazing sheet 34 and provides additional stiffness and structural strength to the glazing panel 141. Using silicone sealant, a conventional air barrier seal is created between the fixed panel 141 and the exterior building sub frame structure 142. In part, the fixed glazing panel supports an operable sealed frame, triple glazing panel 145 that is similar in construction to the operable casement window described in FIG. 15 except that the triple exterior glazing sheet extends over the entire front face 147 of the pultruded fibre glass profile 146. The outer rain screen seal is formed by means of rubber gaskets 148 that are adhered to the front perimeter side edges 149 of the fixed 141 and operable glazing panel 145. For enhanced airtightness, there are double air seals 150 and 151 that are made from conventional rubber gaskets that are attached to an inner window frame profile 152.

Figure 18:
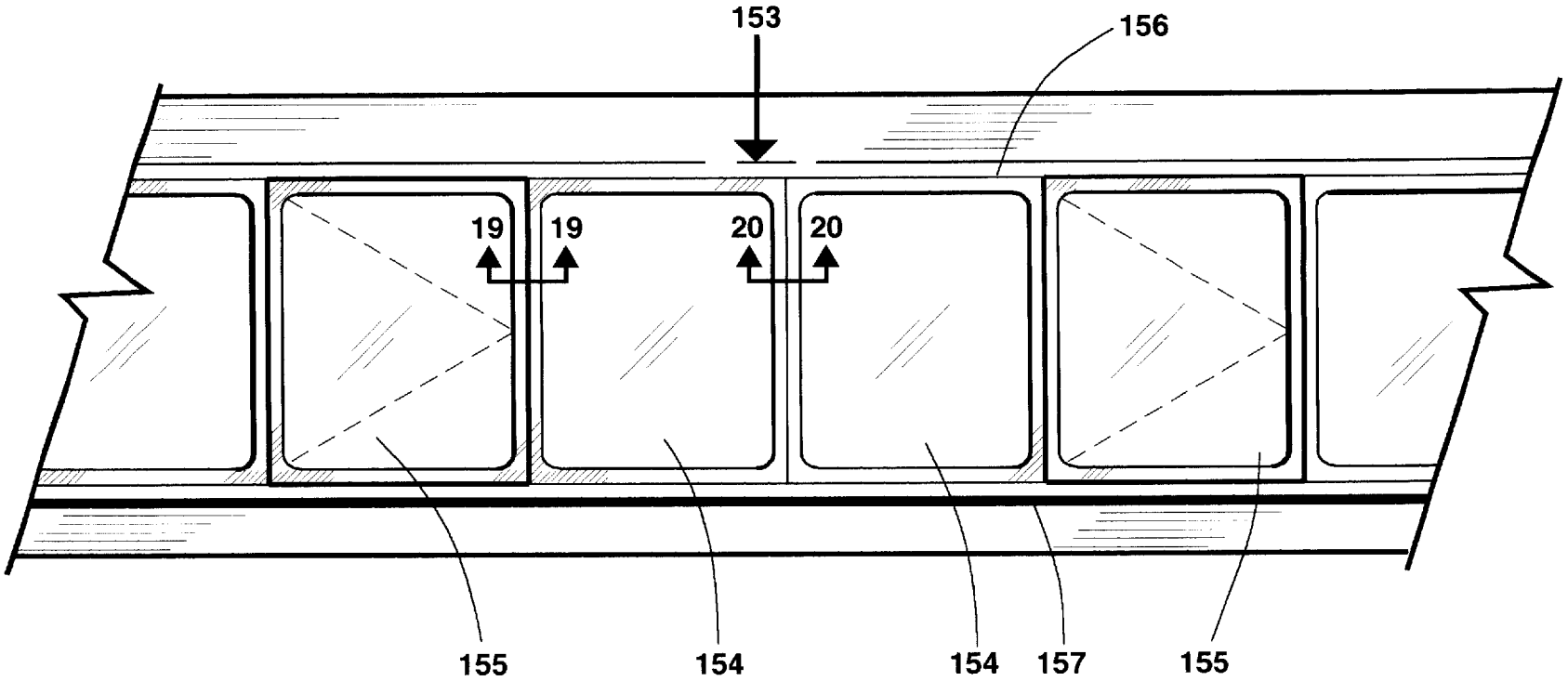
FIG. 18. shows an elevation view of a fixed ribbon window.

FIG. 18. shows an elevation view of a ribbon window assembly 153 for a commercial building where the ribbon window assembly incorporates both fixed 154 and operable sealed frame, insulating glazing panels 155. The fixed sealed frame, insulating glazing panels 154 span unsupported between a top 156 and bottom frame member 157.

Figure 19:
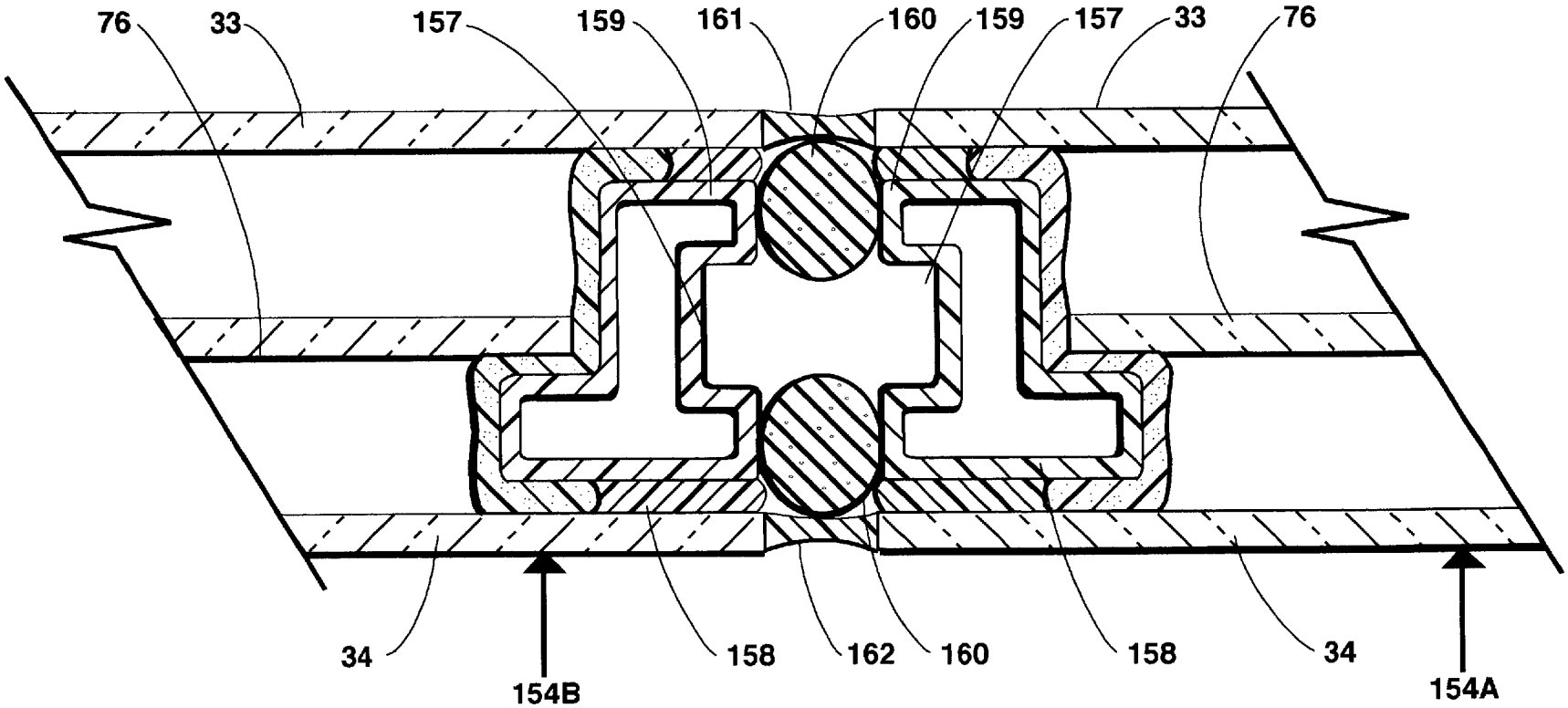
FIG. 19. shows a cross-section ribbon window detail between two fixed sealed frame, triple glazed panels.

FIG. 19. shows a horizontal cross section through two adjacent fixed sealed frame, triple glazing panels 154 incorporating a stepped frame pultruded fibre glass profile 157. The wider face 158 of the stepped profile is on the exterior side of the building while the narrower face 159 is on the interior side. The inner 33, outer 34 and center 76 glazings are adhered to a stepped frame profile 157 creating a stiff panel assembly that can span unsupported between top and bottom window frame members 156 and 157. Assuming that no special devices like breather tubes are used, and if excessive glass bowing is to be avoided the maximum overall panel width is about 50 mm. The two glazing panels 154A and 154B are located about 9 mm apart. Polyethylene foam backing rods 160 are located between the glazing panels 154A and 154B. Silicone sealant is used to seal both the inner 161 and the outer 162 joints creating a clean uncluttered band of glass on both the interior and exterior.

Even though a 50 mm wide stressed skin glass panel is comparatively stiff, especially when re-enforced with rigid fibreglass profile 157, the maximum span of the panel between the top and bottom supports 156 and 157 is about 1.5 m depending on such factors as local wind exposure, glass thickness, panel size etc. and so this means that the panel cannot span unsupported between two adjacent floors of a high rise building.

Figure 20:
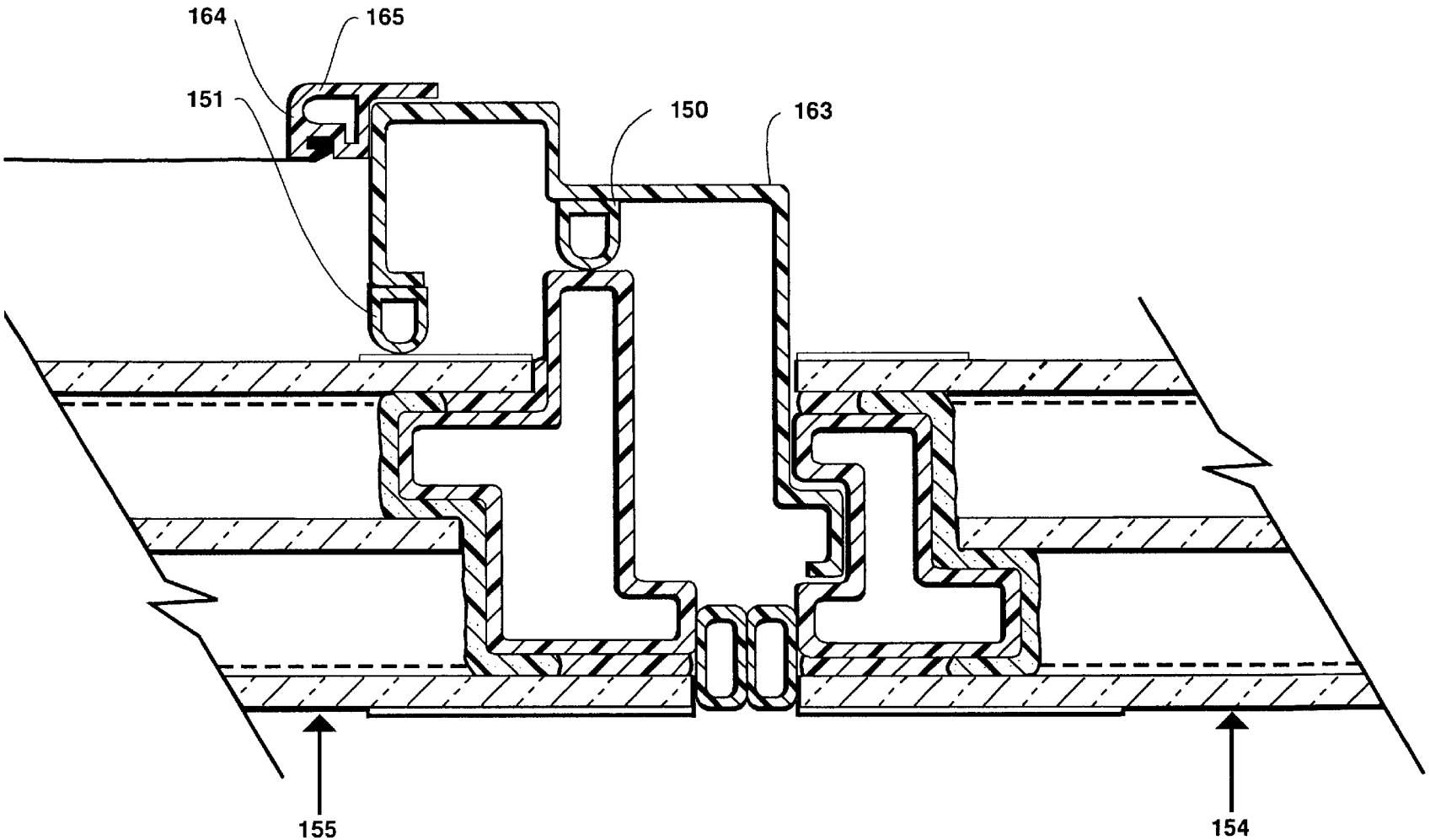
FIG. 20 shows a cross section detail between a fixed and operable sealed frame, triple glazed panels.

FIG. 20. shows a horizontal cross section through a fixed 154 and operable sealed frame glazing panel 155. The operable sealed frame glazing panel 155 consists of a casement window triple-glazed panel 155 that is similar to the operable sealed frame casement panel 145 described in FIG. 17. A fibre glass frame profile 163 is screw fixed to the two adjacent fixed sealed frame, insulating panels 154 and also by means of corner connections to bottom and top frames 156 and 157 (FIG. 18). As with the operable sealed frame, insulating glazing panel for the curtain wall glazing, there are double air seals 150 and 151 that are made from conventional rubber gaskets that attach to the profile 163. A conventional removable insect screen 164 made with a pultruded fibre glass frame 165 is attached to the profile 163. In combination, the slim-line frame assembly extends about 30 mm into the interior space and the width of the slim-line frame profile is about 50 mm and so that there is minimal visual obstruction by the operable window.

It should be noted that although a ribbon window for a commercial building is described in FIGS. 18 to 20, it can be appreciated by those skilled-in-the-art, that similar sealed frame insulating glazing panel assemblies are applicable to various residential window types including, bow windows, bay windows, garden windows and combination panels of fixed and operable casement windows.

FIGS. 21, 22, 23, and 24 illustrate stressed skin glazing panel construction where the width of the stressed skin panels is greater than 50 mm. With stressed skin panel construction, the skins are joined and adhered to the supporting frame so that in combination, the two skins and frame structurally act as an integral unit with the two skins carrying some of the structural loads so that the combined skin-and-frame assembly has greater load carrying capacity than if its individual members were installed separately.

Figure 22:
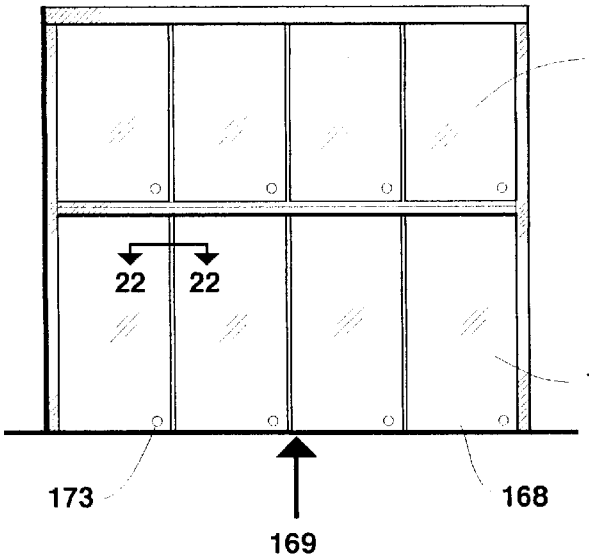
FIG. 22. shows a side elevation of a sun room constructed using sealed frame, double glazed, stressed skin panels.
Figure 21:
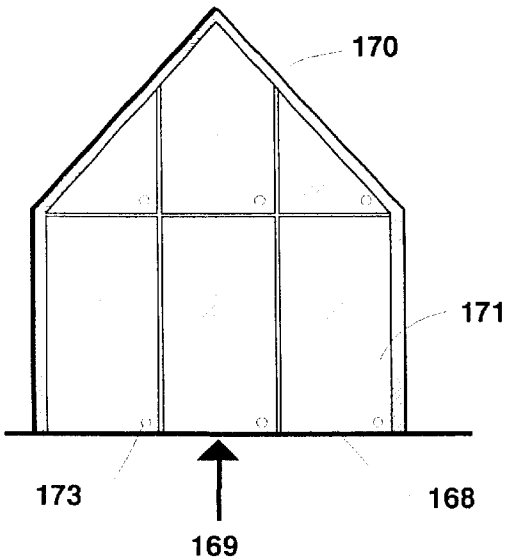
FIG. 21. shows a front elevation of a sun room constructed using sealed frame, double glazed, stressed skin panels.

FIGS. 21 and 22 show a front and side elevation views of an attached sun room 169 fabricated from stressed skin glass panels 168. Except for the end panel fascias 170, the combination of the wall and roof panels 171 and 172 create an all-glass exterior and interior look. Each panel incorporates a device 173 that consists of a long thin breather tube filled with desiccant material. As air pressure fluctuates within the sealed unit, air is either sucked in or extracted through the breather tube. The desiccant material within the breather tube dries out the incoming air and ensures that there is no moisture build-up within the stressed skin panels 168. Eventually, the desiccant material is degraded through moisture build-up and it has to be replaced on a regular maintenance schedule.

Figure 23:
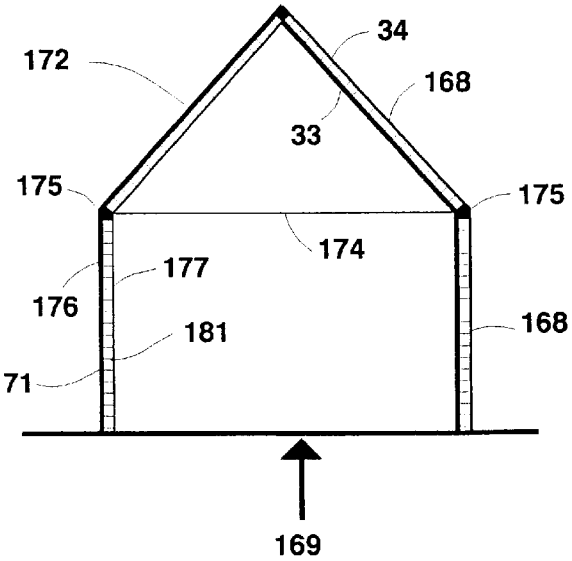
FIG. 23. shows a cross section of a sun room constructed using sealed frame, double glazed, stressed skin panels.

FIG. 23. shows a cross section through the attached sun room 169. The stressed wall panels 171 that are about 3 meters in height fully support the roof panels 172 and there is no separate structural sub frame. To carry the outward tensile forces, from the roof assembly, a metal steel rod 174 interconnects the two opposite sides of the sun room at the wall/roof glazing junction 175.

To provide the required structural stiffness of the panels 171, 172, the glazing sheets, 33 and 34 are spaced apart a minimum of 70 mm and preferably at least 100 mm apart with the spacing varying depending on the sun room geometry, building size, panel size and local climatic conditions such as winter snow and ice loads. In designing the glass stressed skin structure, there is a need for some structural redundancy so that if a single glass sheet randomly shatters or breaks, there is not catastrophic structural failure. Consequently, the stressed skin glazing panels are constructed from inner and outer laminated glass sheet 176 and 177 (FIG. 23) where each laminated glass sheet is fabricated from a minimum of two separate tempered or heat strengthened glass sheets 178 and 179 (FIG. 24) that are laminated and adhered together through the use of a PVB inter layer 180.

For optimum thermal performance of a conventional double glazed insulating glass unit, glazing sheets are spaced about 12 to 15 mm apart and if the glazing sheets are spaced further apart, there is increased convection flow within the glazing unit and so thermal performance is downgraded. One way of dampening convection flow and increasing energy efficient is through the use of honey comb convection suppression devices. As shown in FIG. 23, one preferred convection flow device 181 is manufactured by Advanced Glazings of Sydney, Nova Scotia. The product is marketed under the name InsolCore.® The product is made from flexible polypropylene plastic film that is heat welded together to form a honeycomb convection suppression device that is suspended between the two glazing sheets.

Figure 24:
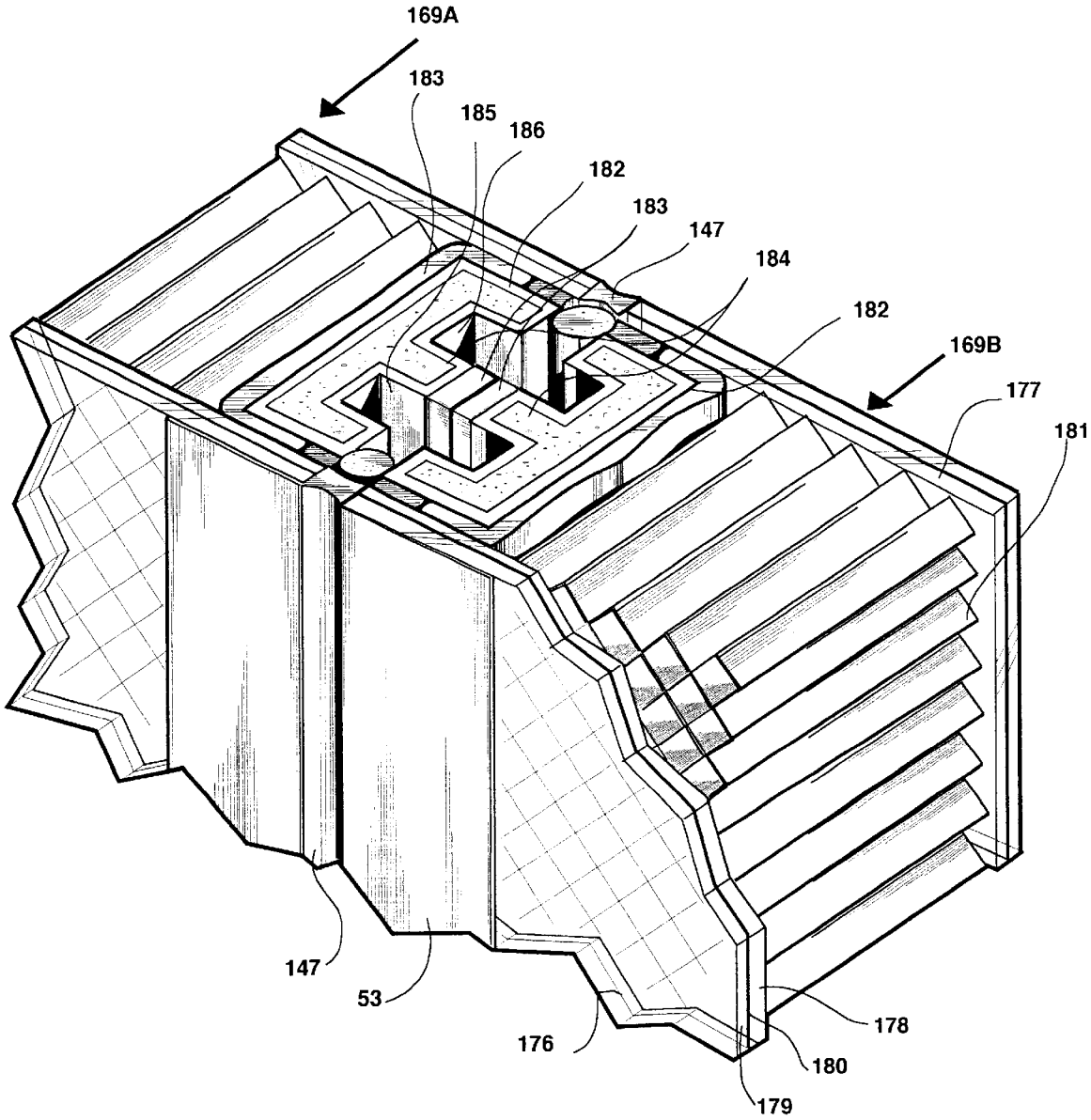
FIG. 24. shows a cross section perspective view of the joint between two sealed frame, double glazed, stressed skin panels.

FIG. 24. shows a perspective cross section view of the joint between two stressed skin glass panels. The panels are fabricated from two laminated glazing sheets 176 and 177 that are spaced apart by hollow, foam-filled, E-shaped, pultruded fibre glass profiles 182. The laminated glazings are adhered to the profiles using silicone sealant or alternatively a modified low permeable silicone sealant that is protected from direct UV exposure by decorative strips 53 and 54. The front face of the profile 182 is coated with low permeable, desiccant filled material. One option is to directly apply the sealant material to the fibre glass profile 182. An alternative option is to apply the sealant in flat sheet strips which are then adhered to the pultruded fibre glass profile 182.

The two panels 169A and 169B are spaced about 9 mm apart. Both the interior and exterior joints are filled with silicone sealant 147. Flexible foam strips 183 are attached to both center tongues 184 of the E-shaped profiles 182 creating two separate cavity spacer 185 and 186.

We claim:

1. A fenestration sealed frame, insulating glazing panel having an integral generally planar frame that is formed by a number of rigid plastic framing profiles having interconnected ends that define corners of said frame, said plastic framing profiles being fabricated in a material that has a low heat conductivity compared to aluminum and a coefficient of expansion that is similar to that of glass;

two glazing sheets arranged in spaced parallel relationship and attached to opposite sides of said frame to define therebetween a sealed insulating cavity;

each said framing profile in section having an overlap portion that is overlapped by said sheets, said overlap portion of each said framing profile defining on opposite sides thereof an elongate seat to receive a marginal edge region of a corresponding one of said glazing sheets;

each said framing profile having a front face that is located between said elongate seats thereof and is directed into said cavity;

each said elongate seat being of L-shape in cross-section and having first and second sections that are parallel to a major surface and to an edge surface respectively, of an associated one of said glazing sheets, said glazing sheets being adhered to said first and second sections of each of said seats by a structural sealant material that exhibits thermosetting properties; and a cavity perimeter seal forming a continuous seal between said glazing sheets around the periphery of said cavity.

2. A fenestration sealed frame, insulating glazing panel as claimed in claim 1 wherein said cavity perimeter seal comprises a low permeability sealant incorporating a desiccant material that is exposed to said cavity.

3. A fenestration sealed frame, insulating glazing panel as claimed in claim 1 wherein a portion of said frame lies outside the extent of said sheets.

4. A fenestration sealed frame, insulating glazing panel as claimed in claim 1 including a decorative feature applied to the perimeter of at least one said glazing sheet to cover at least part of said structural sealant material.

5. A fenestration sealed frame, insulating glazing panel as claimed in claim 4 wherein said decorative feature is located on an exterior face of an exterior one of said glazing sheets, and wherein said decorative feature is a thin film strip of fluoroelastomer material that is adhered to said exterior face.

6. A fenestration sealed frame, insulating glazing panel of claim 5 where said panel is a window.

7. A fenestration sealed frame, insulating glazing panel of claim 5 where said panel is a door.

8. A fenestration sealed frame, insulating glazing panel as claimed in claim 1 wherein said rigid plastic profiles are made from pultruded fibreglass material.

9. A fenestration sealed frame, insulating glazing panel as claimed in claim 1 wherein said rigid plastic profiles are made from structural plastic foam material.

10. A fenestration sealed frame, insulating glazing panel as claimed in claim 1 wherein said rigid plastic profiles are made from oriented thermoplastic material.

11. A fenestration sealed frame, insulating glazing panel as claimed in claim 1 wherein a vapor barrier sheet film material is applied to said front face of each of said framing profiles.

12. A fenestration sealed frame, insulating glazing panel as claimed in claim 1 wherein said structural sealant material is disposed on opposite sides of each of said framing profiles, and said cavity perimeter seal comprises a low permeability sealant covering the front face of each of said framing profiles and extending towards the structural sealant material on opposite sides thereof, and wherein said low permeability sealant is selected from hot melt butyl and polyisobutylene.

13. A fenestration sealed frame, insulating glazing panel as claimed in claim 1 wherein said structural sealant is made from thermosetting silicone material.

14. A fenestration sealed frame, insulating glazing panel as claimed in claim 1 wherein said structural sealant material is disposed on opposite sides of each of said framing profiles, and said cavity perimeter seal comprises a low permeability sealant covering the front face of each of said framing profiles and extending towards the structural sealant material on opposite sides thereof, and wherein said structural sealant material and said low permeability sealant comprise a single material that is a thermoplastic/thermosetting sealant material.

15. A fenestration sealed frame, insulating glazing panel as claimed in claim 14 wherein said thermoplastic/thermosetting sealant is made from a modified silicone material.

16. A fenestration sealed frame, insulating glazing panel as claimed in claim 14 wherein said thermoplastic/thermosetting sealant is made from a modified polyurethane material.

17. A fenestration sealed frame, insulating glazing panel as claimed in claim 1 wherein at least one operating device is attached to said panel to facilitate movement of said panel between open and closed positions.

18. A fenestration sealed frame, insulating glazing panel as claimed in claim 1 including a third glazing sheet positioned in parallel relationship between said two glazing sheets, said third glazing sheet having a perimeter that is attached to said frame to divide said sealed insulating cavity into parallel sub-cavities.

19. A fenestration sealed frame, insulating glazing panel as claimed in claim 18 wherein said third glazing sheet is similar in shape to and smaller in size than one of said two glazing sheets, said framing profiles in cross-section being of stepped configuration to support said perimeter of the third glazing sheet at a location that is offset towards the interior of said insulating cavity from the perimeter of at least one of said two glazing sheets.

20. A fenestration sealed frame, insulating glazing panel as claimed in claim 19 wherein said third glazing sheet is attached to one or more of said two glazing sheets by means of one or more flexible insulating spacers with pre-applied pressure sensitive adhesive on the sides of said spacers.

21. A building wall having an exterior side and an interior side, said wall defining therein a window opening defined by a perimeter window frame structure mounted on said wall, in combination with a fenestration sealed frame insulating glazing panel as claimed in claim 1, and wherein said panel is operable and is mounted on the exterior side of said wall and overlapping said opening throughout the periphery of said opening.

22. A building wall in combination with a fenestration sealed frame, insulating glazing panel, as claimed in claim 21, wherein an additional removeable glazing panel is located on the interior side of said opening.

23. A building wall in combination with a fenestration sealed frame, insulating glazing panel, as claimed in claim 21, wherein said panel overlaps the exterior perimeter frame structure of a building that supports a glazing wall assembly.

24. A building wall having an exterior side and an interior side, said wall defining therein a window opening having opposed upper and lower edges on which are respective top and bottom supports; in combination with a fenestration sealed frame, insulating glazing panel as claimed in claim 1, said panel being fixed in position on said top and bottom supports and spanning the vertical spacing there between, vertical side edges of said panel when installed being unsupported by said building wall.

25. A building wall in combination with a fenestration sealed frame, insulating glazing panel, as claimed in claim 24, wherein a series of adjacent panels span between said bottom and top support and said adjacent panels are fixed in position.

26. A building wall in combination with a fenestration sealed frame, insulating glazing panel, as claimed in claim 24, wherein an operable panel is located adjacent to said fixed panel and is supported in part by said fixed panel.

27. A fenestration sealed frame, insulating glazing panel as claimed in claim 1, wherein each said glazing sheet is fabricated in laminated glass; and said sheets are spaced apart by at least 70 mm and are attached to form an integral structure with said frame by means of said structural sealant material, said integral structure comprising a stressed skin panel.

28. A fenestration sealed frame, insulating glazing panel as claimed in claim 27 wherein said panel incorporates a passage through which air can enter and leave said panel, said passage incorporating a desiccant material to remove moisture in air that enters said panel.

29. A fenestration sealed frame, insulating glazing panel as claimed in claim 27 further comprising honeycomb transparent insulation located between the glazing sheets and wherein said honeycomb insulation is made from flexible plastic film material.

30. A building enclosure fabricated from a plurality of panels, each of said panels comprising a fenestration sealed frame, insulating glazing panel as claimed in claim 27, wherein said panels are self supporting and there is no separate building structure frame.

* * * * *